US011506996B2

(12) United States Patent
Takarada et al.

(10) Patent No.: US 11,506,996 B2
(45) Date of Patent: Nov. 22, 2022

(54) CONVEYANCE UNIT, PROCESS CARTRIDGE, AND IMAGE FORMING APPARATUS

(71) Applicant: CANON KABUSHIKI KAISHA, Tokyo (JP)

(72) Inventors: Hiroshi Takarada, Kawasaki (JP); Masaaki Sato, Yokohama (JP); Koji Wada, Yokohama (JP); Tsuyoshi Ogawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/523,742

(22) Filed: Nov. 10, 2021

(65) Prior Publication Data

US 2022/0066355 A1 Mar. 3, 2022

Related U.S. Application Data

(63) Continuation of application No. 17/026,553, filed on Sep. 21, 2020, now Pat. No. 11,199,794.

(30) Foreign Application Priority Data

Sep. 27, 2019 (JP) ..... JP2019-178027

(51) Int. Cl.
*G03G 15/08* (2006.01)
*G03G 21/18* (2006.01)

(52) U.S. Cl.
CPC ..... *G03G 15/0891* (2013.01); *G03G 15/0874* (2013.01); *G03G 21/1814* (2013.01); *G03G 2215/083* (2013.01)

(58) Field of Classification Search
CPC ..... G03G 2215/083; G03G 15/0891; G03G 2215/0833
See application file for complete search history.

(56) References Cited

U.S. PATENT DOCUMENTS

| | | | | |
|---|---|---|---|---|
| 5,264,900 | A * | 11/1993 | Momiyama | G03G 15/0877 399/256 |
| 7,835,672 | B2 * | 11/2010 | Sakamoto | G03G 15/0822 399/256 |
| 9,568,858 | B2 * | 2/2017 | Oda | G03G 15/0891 |
| 10,338,494 | B2 * | 7/2019 | Takaya | G03G 15/0808 |
| 2008/0145109 | A1 * | 6/2008 | Murayama | G03G 15/0877 399/260 |
| 2013/0223856 | A1 * | 8/2013 | Koyama | G03G 15/556 399/258 |
| 2017/0060031 | A1 * | 3/2017 | Iida | G03G 15/0844 |
| 2018/0107137 | A1 * | 4/2018 | Okamura | G03G 15/105 |

* cited by examiner

*Primary Examiner* — Sevan A Aydin
(74) *Attorney, Agent, or Firm* — Canon U.S.A., Inc. I.P. Division

(57) ABSTRACT

A conveyance mechanism which includes a rotation shaft extending in a direction along a first direction connecting first and second discharge ports that is rotatable with a rotation axis extending in the first direction. Wherein, a first rotation conveyance unit is disposed on the rotation shaft, and is rotatable together with the rotation shaft, conveys developer toward the first discharge port, and a second rotation conveyance unit is disposed on the rotation shaft, and is rotatable together with the rotation shaft, conveys developer toward the second discharge port. The second rotation conveyance unit is configured to provide a larger amount of conveyance than the first rotation conveyance unit.

20 Claims, 15 Drawing Sheets

CONVEYANCE UNIT, PROCESS CARTRIDGE, AND IMAGE FORMING APPARATUS

CROSS-REFERENCE TO RELATED APPLICATIONS

The present application is a continuation of U.S. patent application Ser. No. 17/026,553, filed on Sep. 21, 2020, which claims priority from Japanese Patent Application No. 2019-178027 filed Sep. 27, 2019, which are hereby incorporated by reference herein in their entireties.

BACKGROUND

Field of the Disclosure

The present disclosure relates to an image forming apparatus, a conveyance unit and a process cartridge used for the image forming apparatus. More particularly, the present disclosure relates to an electrophotographic image forming apparatus, a conveyance unit and a process cartridge used for the electrophotographic image forming apparatus.

Description of the Related Art

Generally, an image forming apparatus employing an electrophotographic method forms an image by transferring a toner image formed on the surface of a photosensitive drum to a transfer material as a transfer medium. Examples of known developer replenishing methods include a process cartridge method and a toner replenishing method. In the process cartridge method, when developer runs out, a process cartridge integrating a photosensitive drum and a development container is replaced with a new one.

In the toner replenishing method, when toner runs out, new toner is replenished to the development container. Conventionally, as discussed in Japanese Patent Laid-Open No. H08-30084, a one-component development device is discussed which employs a toner replenishing method in which a toner supply box for supplying toner is connected to a toner conveyance path for conveying toner. The toner accumulated in the toner supply box is conveyed to the toner conveyance path by a conveyance screw.

In recent years, there is demand from users for various methods including the above-described process cartridge method and toner replenishing method for image forming apparatuses.

SUMMARY

An aspect of the present disclosure provides an image forming apparatus, a conveyance unit and a process cartridge used for the image forming apparatus.

According to one aspect of the present disclosure, there is provided a conveyance unit including a developer container including a storage chamber configured to store developer, a replenishing port, disposed on one longitudinal side of the storage chamber, configured to supply developer from outside to the storage chamber. There is a first discharge port, disposed on the one longitudinal side of the storage chamber, configured to discharge the developer from the storage chamber, and a second discharge port, disposed on the other longitudinal side at a position further from the replenishing port than the first discharge port, configured to discharge the developer from the storage chamber. A conveyance mechanism is disposed in the developer container and can convey the developer stored in the storage chamber from the replenishing port to the first and the second discharge ports. The conveyance mechanism includes a rotation shaft extending in a direction along a first direction connecting the first and second discharge ports, which is rotatable with a rotation axis extending in the first direction, a first rotation conveyance unit disposed on the rotation shaft, configured to be rotatable together with the rotation shaft and convey the developer toward the first discharge port, and a second rotation conveyance unit disposed on the rotation shaft, configured to be rotatable together with the rotation shaft and convey the developer toward the second discharge port. Wherein the second rotation conveyance unit is configured to provide a larger amount of conveyance than the first rotation conveyance unit.

Further features of the present disclosure will become apparent from the following description of exemplary embodiments (with reference to the attached drawings).

DESCRIPTION OF THE EMBODIMENTS

Figure 1:
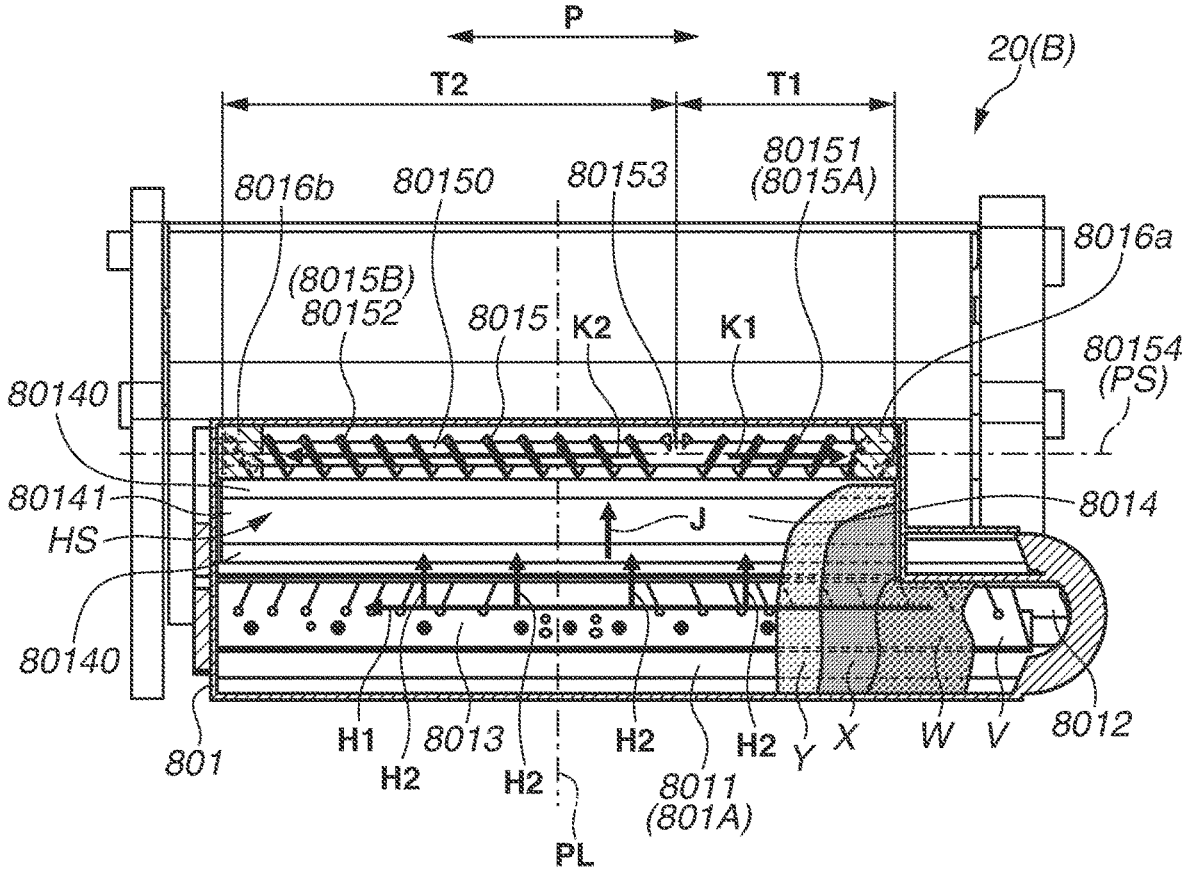
FIG. 1 is a plan view illustrating a toner reception unit (the state where the upper surface is omitted) of a conveyance unit used in an image forming apparatus according to a first exemplary embodiment

The present disclosure can also be implemented in any one embodiment of an electrophotographic image forming apparatus (hereinafter referred to as an "image forming apparatus") and, a process cartridge (hereinafter simply referred to as a "cartridge") and a conveyance unit configuring a part of the image forming apparatus.

The image forming apparatus according to the present disclosure will be described below with reference to the accompanying drawings.

The following exemplary embodiments are to be considered as illustrative and not restrictive of the scope of the present disclosure. Sizes, materials, shapes, and relative arrangements of elements described in the exemplary embodiments are not limited thereto. Unless otherwise specifically described, the scope of the present disclosure is not limited to the exemplary embodiments described below.

An electrophotographic image forming apparatus refers to an apparatus for forming an image on a recording medium by using an electrophotographic image forming method. Examples of electrophotographic image forming apparatuses include electrophotographic copiers, electrophotographic printers (e.g., laser beam printers and light emitting diode (LED) printers), facsimile apparatuses, and word processors.

The conveyance unit used for the image forming apparatus can be integrally formed with a development device as a part of the development device. The development device includes at least a developing unit. The conveyance unit or the development device including the conveyance unit is configured as a cartridge that can be attachable to and detachable from the apparatus body of the image forming apparatus.

A process cartridge (also simply referred to as a cartridge) configures a part of the image forming apparatus. The process cartridge integrates at least a conveyance unit, a development device, and an electrophotographic photosensitive drum as a cartridge. This cartridge is attachable to and detachable from the apparatus body of the image forming apparatus. The process cartridge may also be configured to be fixed to the image forming apparatus.

In the following descriptions, the longitudinal direction of the process cartridge coincides with the rotation axial direction of the photosensitive drum as an image bearing member.

Reference numerals in the descriptions are intended to refer to drawings and do not limit the configuration.

First Exemplary Embodiment

First of all, the configuration of an electrophotographic image forming apparatus and an image forming process will be described below.

Figure 2A:
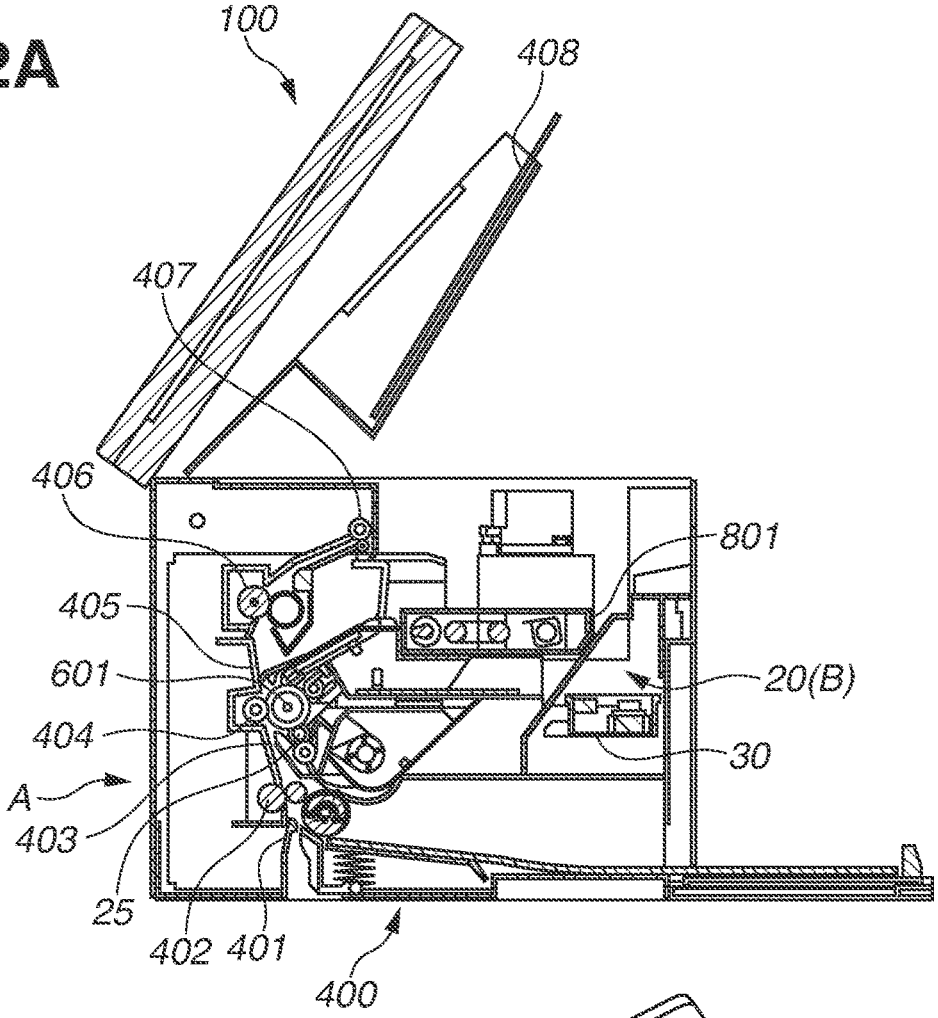
FIG. 2A is a cross-sectional view illustrating the image forming apparatus according to the first exemplary embodiment.
Figure 2B:
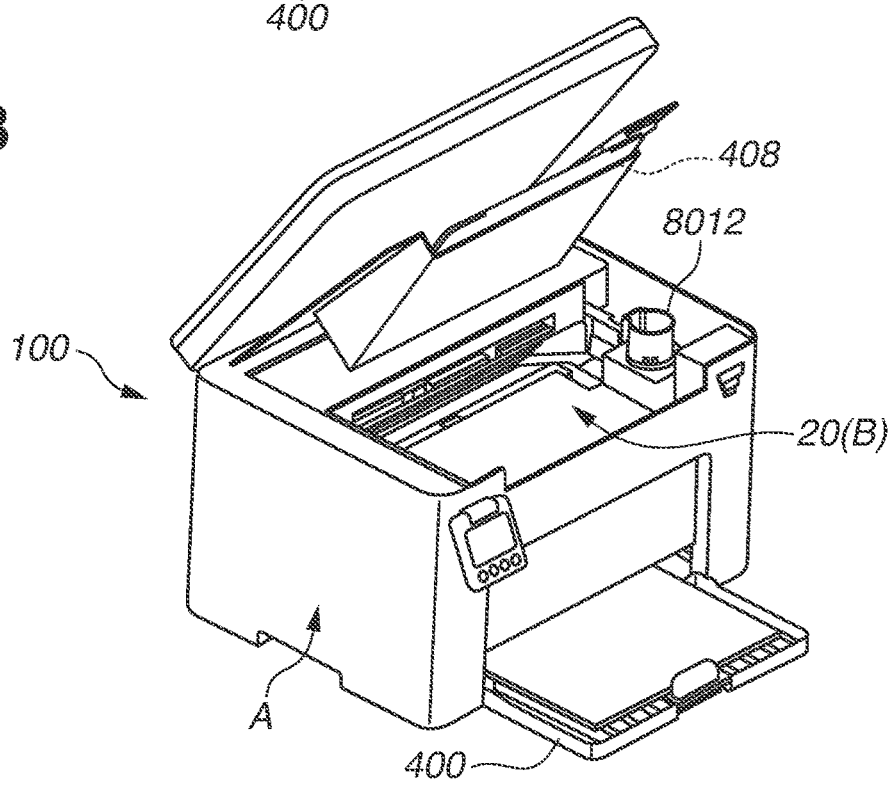
FIG. 2B is a perspective view illustrating the image forming apparatus.
Figure 3:
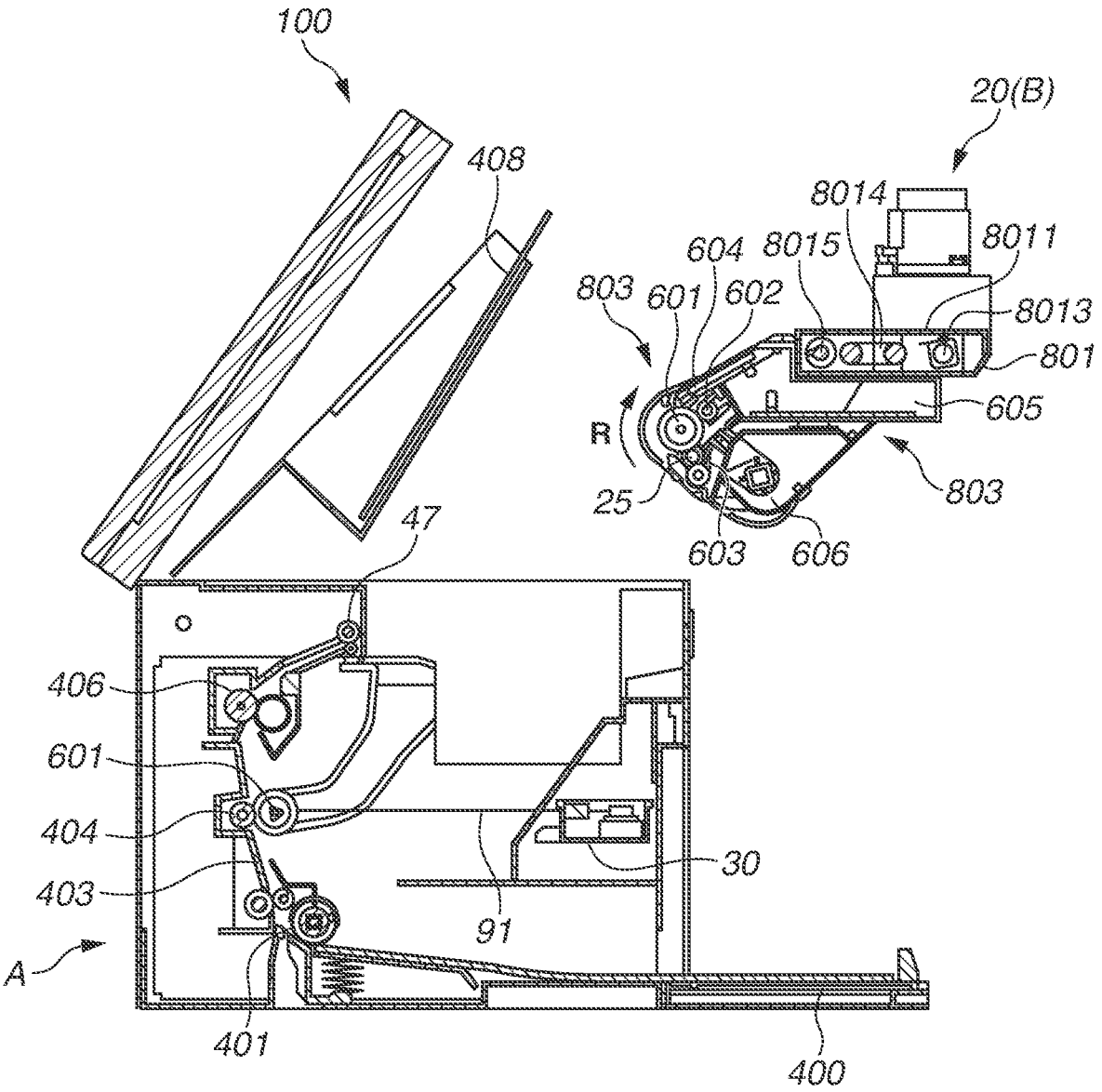
FIG. 3 is a cross-sectional view illustrating a state where a process cartridge is detached from the apparatus body of the image forming apparatus according to the first exemplary embodiment.
Figure 4A:
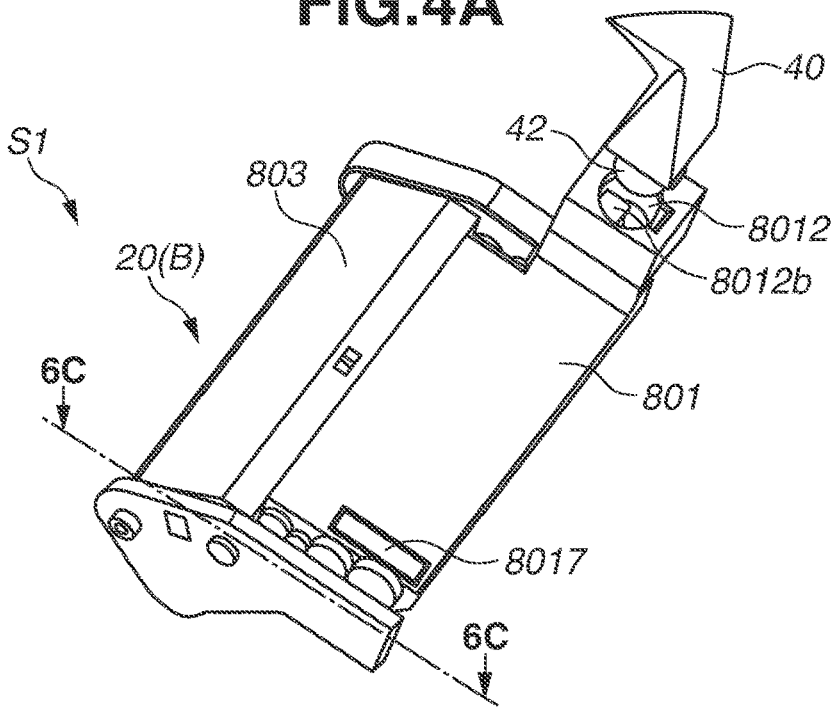
FIG. 4A is a perspective view illustrating the process cartridge and a toner pack used for the image forming apparatus according to the first exemplary embodiment.
Figure 4B:
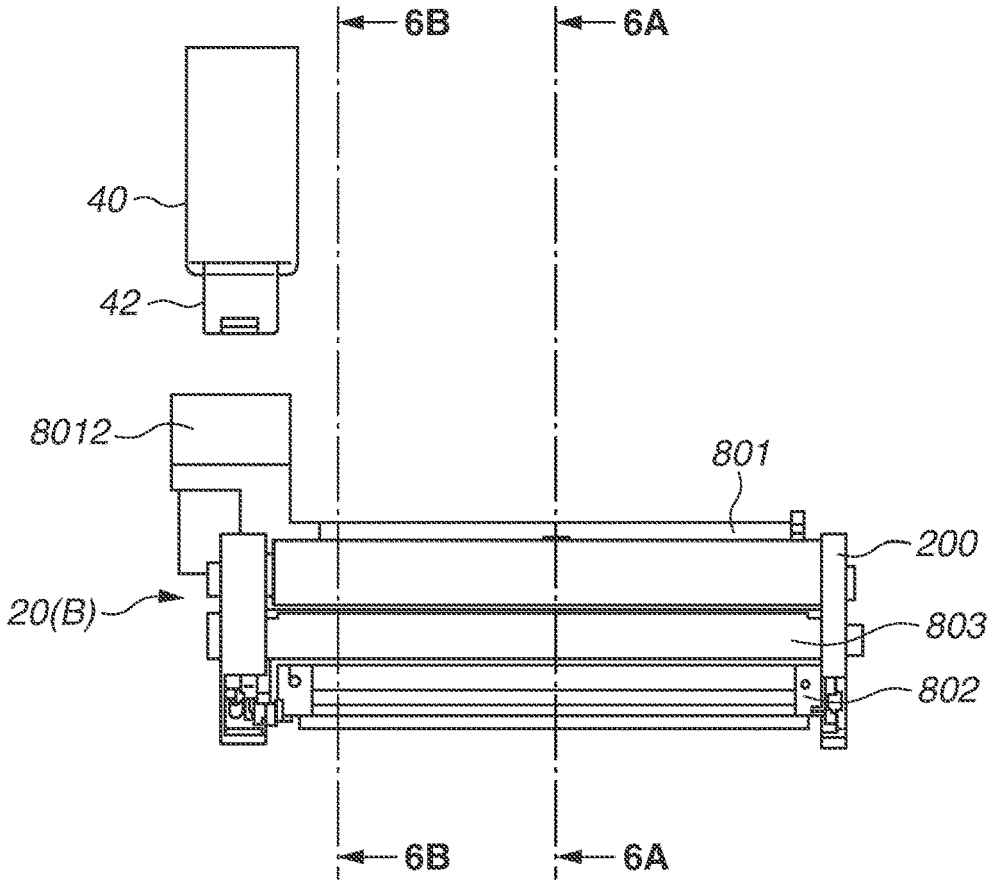
FIG. 4B is a side view illustrating the process cartridge and the toner pack when viewed from the direction S1 illustrated in FIG. 4A.

FIGS. 2A and 2B illustrate a state where a cartridge B (process cartridge) is attached to an apparatus body A of an image forming apparatus 100. FIG. 3 illustrates a state where the cartridge B is detached.

The apparatus body A is a part other than the cartridge B of the image forming apparatus 100.

The configuration of the image forming apparatus 100 will be described below with reference to FIGS. 2A and 2B.

As illustrated in FIGS. 2A and 2B, the image forming apparatus 100 according to the first exemplary embodiment is a laser beam printer utilizing the electrophotographic technology in which the cartridge B (process cartridge) is attachable to and detachable from the apparatus body A.

A sheet tray 400 for stacking recording media (e.g., recording paper, hereinafter referred to as sheets) as an image forming target is disposed under the cartridge B.

In the apparatus body A, a pickup roller 401, a conveyance roller pair 402, a transfer guide 403, a transfer roller 404 (transfer member), a conveyance guide 405, a fixing roller pair 406, a discharge roller pair 407, an output tray 408, and so on are sequentially disposed in this order along the sheet conveyance direction.

The overview of the image forming process will be described below with reference to FIGS. 2A, 2B, and 3.

A photosensitive drum 601 as an image bearing member is rotationally driven at a predetermined circumferential speed (process speed) in the direction R (see FIG. 3) based on a printing start signal.

A charge roller 602 applied with a bias voltage contacts the outer circumferential surface of the photosensitive drum 601 to uniformly charge the outer circumferential surface of the photosensitive drum 601.

An exposure device 30 outputs a laser beam 91 corresponding to image information to perform scanning exposure on the outer circumferential surface of the photosensitive drum 601. Thus, an electrostatic latent image corresponding to the image information is formed on the outer circumferential surface of the photosensitive drum 601.

On the other hand, in the development device 20 illustrated in FIG. 3, the developer (hereinafter referred to as "toner") in a toner reception unit container 8011 is stirred/conveyed and then sent out to a toner supply chamber 606 by toner conveyance members 8013 to 8015. The development device 20 configures a part of the cartridge B.

Toner is borne on the surface of a developing roller 25 (developer bearing member) and is triboelectrically charged by a development blade 603. Accordingly, the toner thickness on the circumferential surface of the developing roller 25 is regulated.

Toner is transferred to the photosensitive drum 601 according to an electrostatic latent image and then visualized as a toner image. More specifically, the photosensitive drum 601 bears toner (toner image) and rotates in the direction R.

As illustrated in FIGS. 2A and 2B, a sheet stored at the bottom of the apparatus body A is fed from the sheet tray 400 by the pickup roller 401 and the conveyance roller pair 402 in synchronization with the output timing of the laser beam.

Then, the sheet passes through the transfer guide 403 and then is supplied to the transfer position between the photosensitive drum 601 and the transfer roller 404. At this transfer position, the toner image is sequentially transferred from the photosensitive drum 601 to the sheet.

The sheet with the toner image transferred thereon is separated from the photosensitive drum 601 and conveyed to the fixing roller pair 406 along the conveyance guide 403. Then, the sheet passes through the nip portion.

The toner image having undergone the pressing, heating, and fixing processes at the nip portion is fixed onto the sheet. The sheet having undergone the toner image fixing process is conveyed to the discharge roller pair 407 and then discharged onto the output tray 408.

As illustrated in FIG. 3, residual toner on the outer circumferential surface of the photosensitive drum 601 is removed by a cleaning member 604. The removed toner is reused for the image forming process. The toner removed by the photosensitive drum 601 is stored in a waste toner storage chamber 605 of a cleaning unit 803.

Process Cartridge

The process cartridge (cartridge B) according to the present exemplary embodiment will be described below. In particular, the relation between the cartridge B and a toner pack 40 will be described below.

As illustrated in FIGS. 4A, 4B, and 5A to 5C, the cartridge B according to the present exemplary embodiment includes a toner reception unit 801 (conveyance unit), a development unit 802, and the cleaning unit 803.

The toner reception unit 801, the cleaning unit 803, and the development unit 802 are sequentially disposed in this order from the top in the gravity direction. The toner reception unit 801 will be described below.

The toner reception unit 801 is disposed at the upper portion of the cartridge B and includes the toner reception unit container 8011 (developer container) including a storage chamber 801A for storing toner.

The toner reception unit container 8011 (storage chamber 801A) is provided with a replenishing port 8012 at a longitudinal end. The replenishing port 8012 is connected with the toner pack 40 to receive toner in the toner pack 40. The replenishing port 8012 is configured to be connectable with the toner pack 40.

The toner reception unit 801 includes a second conveyance member 8013, a third conveyance member 8014, and a first conveyance member 8015. More specifically, the second conveyance member 8013 can convey toner in a direction H1. The third conveyance member 8014 can convey toner in the direction J (second direction). The first conveyance member 8015 can convey toner in the directions K1 and K2.

The first, second, and third conveyance member configure a conveyance mechanism HS of the present disclosure. More specifically, the conveyance mechanism HS can include at least one of the first to third conveyance members.

According to the present exemplary embodiment, the second direction J is a direction perpendicularly intersecting a first direction 80154 (described below).

The toner reception unit 801 is provided with a discharge port 8016*a* (first discharge port) and a discharge port 8016*b* (second discharge port) at both longitudinal ends, through which toner is downwardly conveyed in the gravity direction by gravity, from the toner reception unit 801 to the development unit 802.

Therefore, the toner stored in the toner pack 40 is supplied from the replenishing port 8012 into the storage chamber 801A and then conveyed to the discharge ports 8016*a* and 8016*b* by the second conveyance member 8013, the third conveyance member 8014, and the first conveyance member 8015. Toner drops (or is replenished) from the discharge port 8016 to the opening 8021 (see FIG. 5B) by gravity.

Figure 7A:
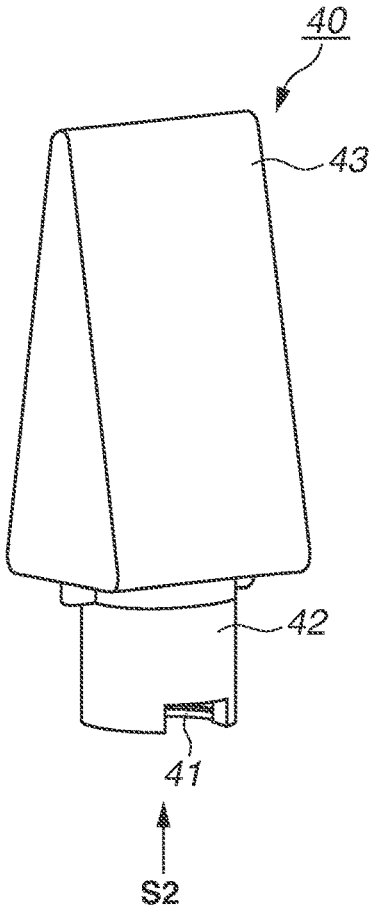
FIG. 7A is a perspective view illustrating the toner pack (when the shutter is opened) used for the image forming apparatus according to the first exemplary embodiment.
Figure 7B:
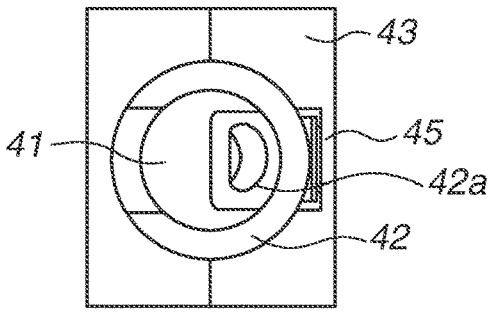
FIG. 7B is a plan view illustrating the toner pack when viewed from the direction S2 illustrated in FIG. 7A.
Figure 7C:
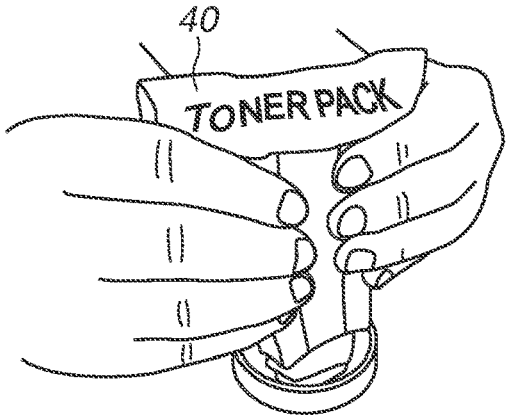
FIG. 7C is a view illustrating an operation when toner is supplied from the toner pack.

FIG. 7A is a conceptual perspective view illustrating the toner pack 40 (when the shutter is opened) used for the image forming apparatus according to the first exemplary embodiment of the present disclosure. FIG. 7B is a conceptual plan view illustrating the toner pack 40 when viewed from the direction S2 illustrated in FIG. 7A. FIG. 7C is a conceptual view illustrating an operation for supplying toner from the toner pack 40.

Figure 6A:
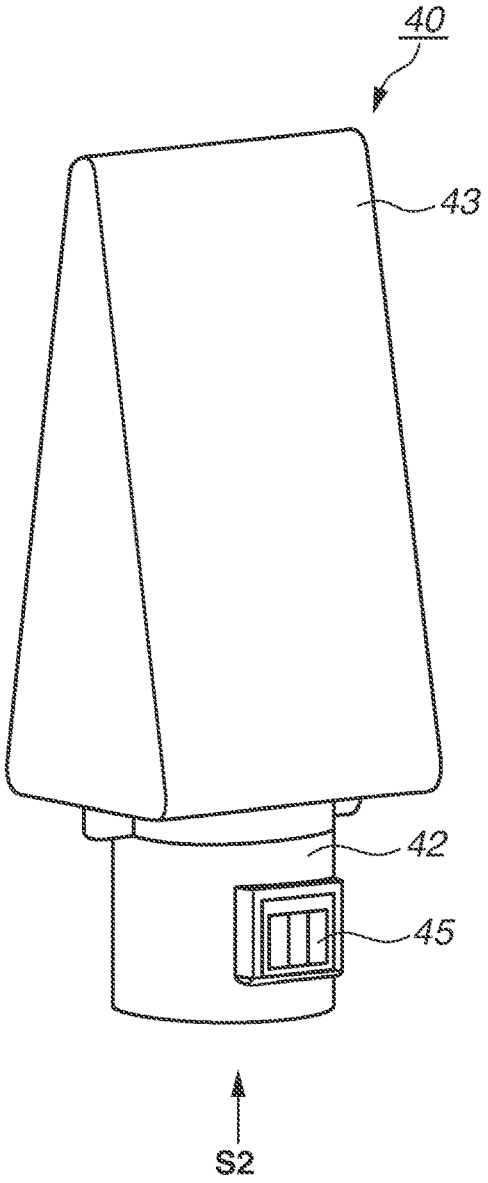
FIG. 6A is a perspective view illustrating the toner pack (when the shutter is closed) used for the image forming apparatus according to the first exemplary embodiment.
Figure 6B:
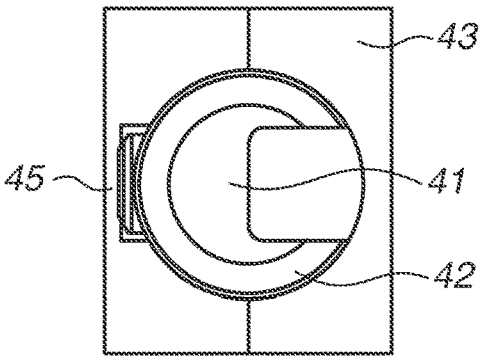
FIG. 6B is a plan view illustrating the toner pack when viewed from the direction S2 illustrated in FIG. 6A.

FIGS. 6A and 7A illustrate the entire shape of the toner pack 40. FIGS. 6B and 7B illustrate the toner pack 40 when viewed from the bottom (bottom view). FIG. 7C illustrates an image in which the user squeezes the toner pack 40 with fingers when replenishing toner.

As illustrated in FIGS. 6A, 6B, and 7A to 7C, the toner pack 40 includes an openable/closable shutter member 41 disposed at the opening, a replenishing port 42 made of resin, a bag member 43 for storing toner, and a storage unit 45 for recording usage information for the toner pack 40.

When supplying toner to the toner reception unit 801, the user positions the toner pack 40 to pass through a projection 8012*b* of the replenishing port 8012 (see FIG. 4A) and then connects the toner pack 40 with the replenishing port 8012.

In this state, when the user rotates the toner pack 40 by 180 degrees by holding the replenishing port 42 of the toner pack 40, the shutter member 41 of the toner pack 40 abuts against the projection 8012*b* (see FIG. 4A) of the replenishing port 8012. Accordingly, the shutter member 41 rotates with respect to the main body of the toner pack 40. This means that the toner pack 40 is configured so that a replenishing opening 42*a* is exposed by the relative movement between the shutter member 41 and the toner pack 40. The toner stored in the toner pack 40 leaks down from the replenishing opening 42*a* of the replenishing port 42. Then, the leaked toner is supplied to the toner reception unit container 8011 (see FIG. 5A) via the replenishing port 8012. An opening/closing operation of the shutter member 41 will be described in detail below.

To discharge toner from the toner pack 40 when the shutter member 41 is opened, it is preferable that the user squeezes the toner pack 40 with fingers.

The shutter member 41 may be omitted. A sliding shutter member may be applied as a substitute for the rotation shutter member 41. The shutter member 41 may be configured to be broken when the toner pack 40 is attached to the replenishing port 8012 or when the toner pack 40 is rotated in the attached state. Alternatively, the shutter member 41 may be a removable cover such as a seal.

Toner Pack

The toner pack 40 will be described below. In particular, a relation between the toner pack 40 and the shutter opening/ closing mechanism of the toner reception unit 801 of the cartridge B, and a relation between the toner pack 40 and the lock mechanism of the shutter member 41 will be described below.

Figure 8A:
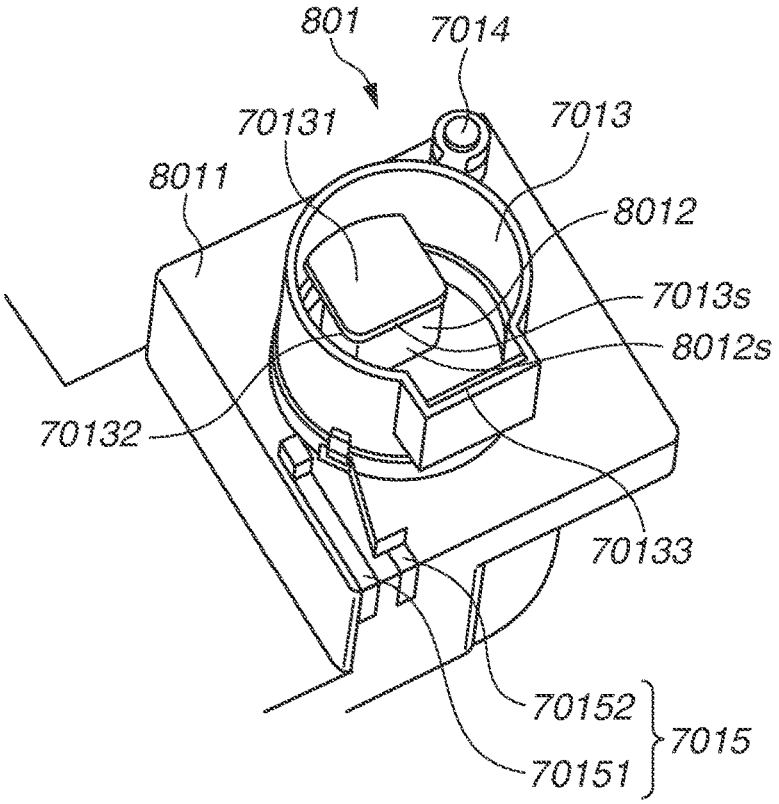
FIG. 8A is an enlarged perspective view illustrating a part of a replenishing port of the toner reception unit, to which the toner pack is attached, used for the image forming apparatus according to the first exemplary embodiment.

As illustrated in FIG. 8A, the replenishing port 8012 is provided with a replenishing port shutter 7013 rotatably attached to the replenishing port 8012. The replenishing port 8012 is also provided with a locking member 7014 for regulating the rotation of the replenishing port shutter 7013, and a rotation detection unit 7015 for detecting the rotation of the replenishing port shutter 7013.

Figure 8B:
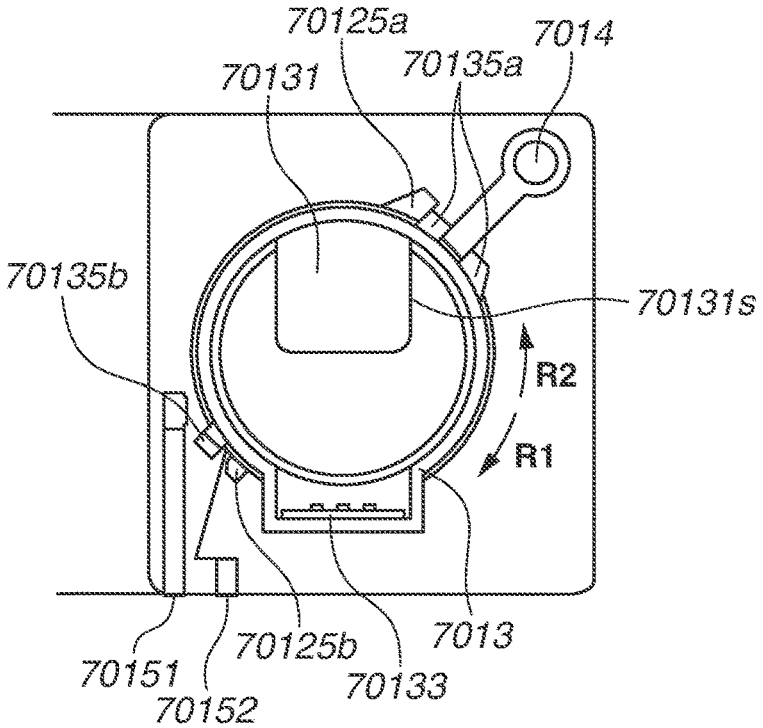
FIG. 8B is a top view illustrating the replenishing port of the toner reception unit.

The rotation detection unit 7015 includes two conductive leaf springs 70151 and 70152. As illustrated in FIG. 8B, the replenishing port shutter 7013 is provided with a cover member 70131 for covering the replenishing port 8012, a reading unit 70133 for reading information recorded in the storage unit 45 of the toner pack 40, and a plurality of projections 70135 for regulating the rotation. The replenishing port 8012 is also provided with a plurality of projections 70125*a* and 70125*b* which comes in contact with the plurality of projections 70135*a* and 70135*b* disposed on the replenishing port shutter 7013, respectively. The replenishing port shutter 7013 is rotated in the direction R1 at the time of attachment and in the direction R2 at the time of detachment.

Another embodiment of the toner pack 40 will be described below with reference to FIGS. 9A to 9D and 10A to 10F.

Figure 9A:
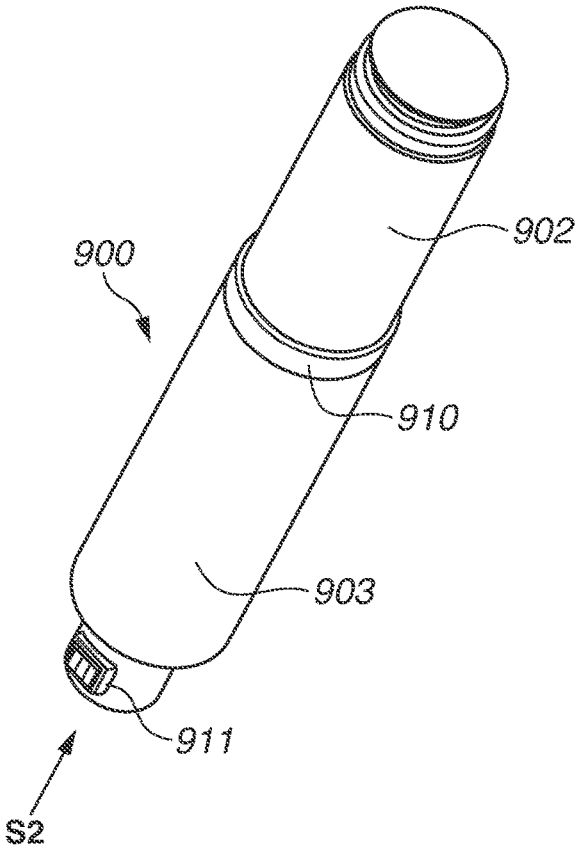
FIG. 9A is a perspective view illustrating a toner bottle unit (before filling) according to a modification of the first exemplary embodiment.
Figure 9B:
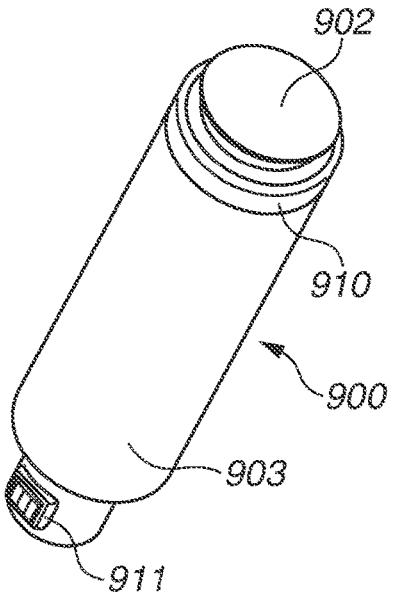
FIG. 9B is a perspective view illustrating the toner bottle unit (after filling)

More specifically, FIG. 9A illustrates the outer appearance of a "toner bottle unit" as another embodiment of the "toner pack" for storing replenishment toner. FIG. 9B illustrates a state where the user pushes a piston to discharge toner.

Figure 10A:
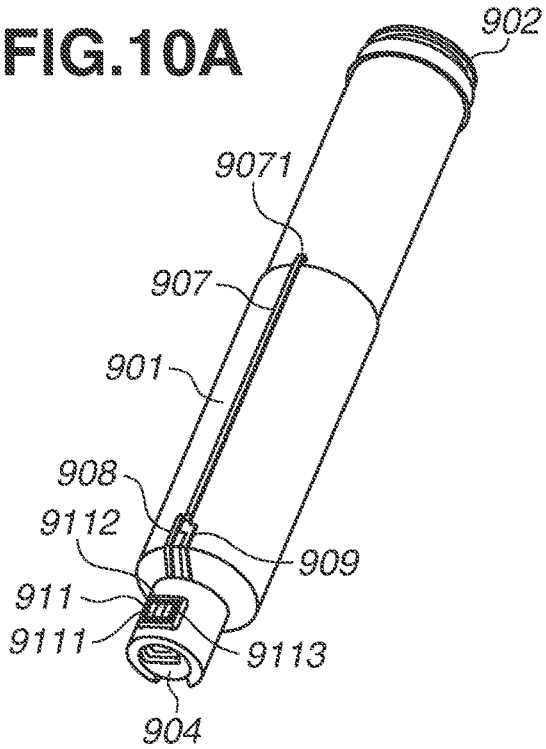
FIGS. 10A to 10F are perspective views illustrating each function unit of a toner bottle unit according to the first exemplary embodiment.
Figure 10B:
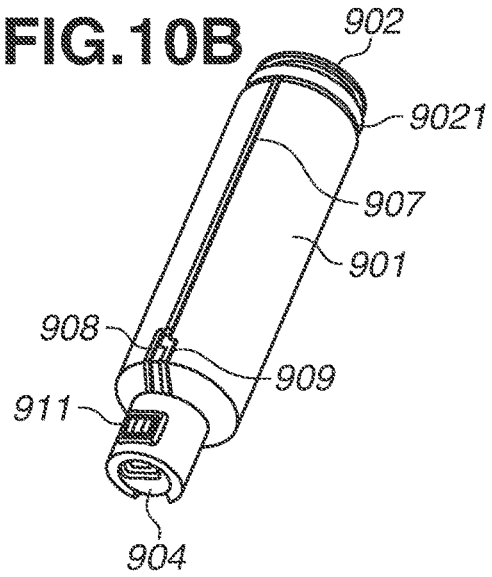
Figure 10C:
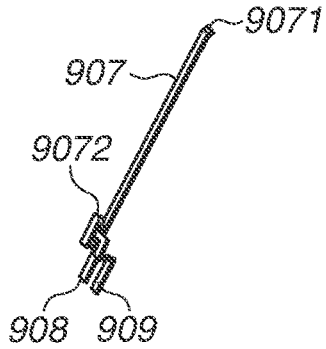

FIG. 10A illustrates the toner bottle unit (the outer cylinder is not illustrated). FIG. 10B illustrates a state where the user pushes the piston to discharge toner (the outer cylinder not is illustrated). FIG. 10C illustrates a state of push-in detection parts before the piston is pushed.

Figure 10D:
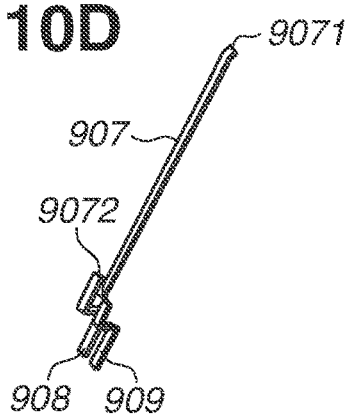
Figure 10E:
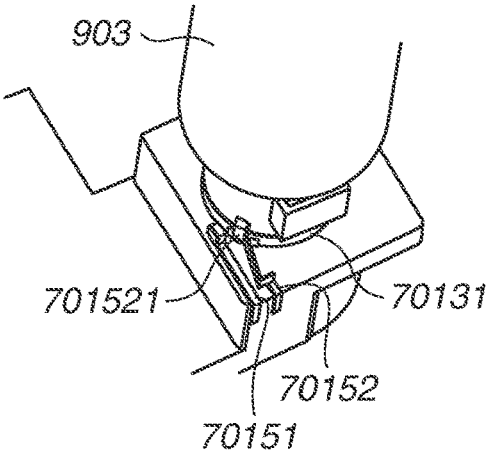

FIG. 10D illustrates a state of the push-in detection parts after the piston is pushed. FIG. 10E illustrates a state of rotation detection parts of the toner bottle before the toner bottle is rotated. FIG. 1OF illustrates a state of the rotation detection parts of the toner bottle after the toner bottle is rotated.

Figure 9C:
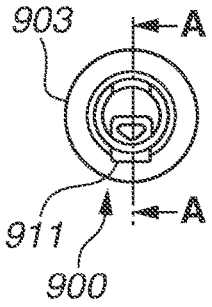
FIG. 9C is a plan view illustrating the toner bottle unit when viewed from the direction S2 illustrated in FIG. 9A.
Figure 9D:
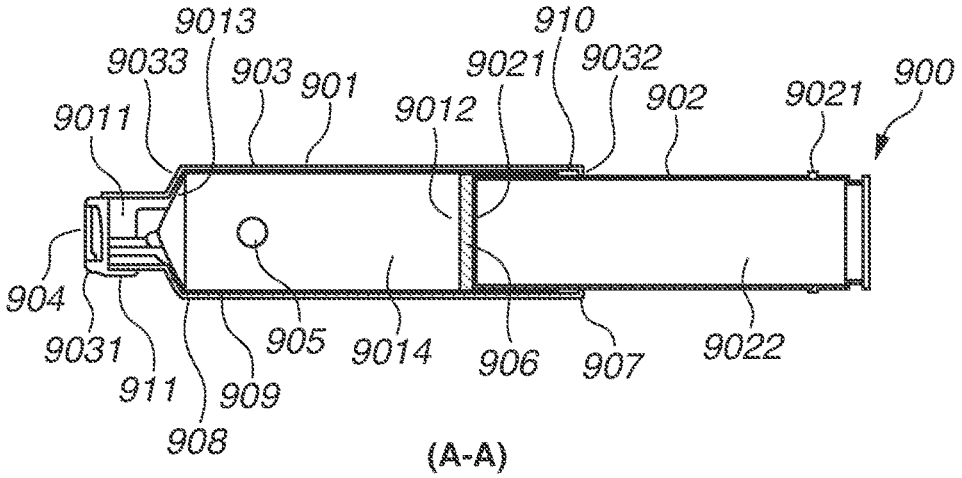
FIG. 9D is a cross-sectional view illustrating the toner bottle unit taken along the section A-A illustrated in FIG. 9C.

As illustrated in FIGS. 9A and 9C, a toner bottle unit 900 includes a cylindrical container 9014 for storing toner, and an inner cylinder 901 having a discharge port 9011 at one end and an opening 9012 at the other end.

The toner bottle unit 900 also includes a cylindrical piston 902 fitting into the opening 9012 of the inner cylinder 901, and a cylindrical outer cylinder 903 including the inner cylinder 901 and having a discharge port 9031 at one end and an opening 9032 at the other end. The toner bottle unit 900 also includes a shutter 904 for sealing the discharge port 9031 of the outer cylinder 903 to be openable and closable.

The toner container 9014 of the inner cylinder 901 includes a weight member 905 having a spherical shape which is freely movable in the toner container 9014.

The piston 902 is provided with an elastic member 906 at a discharge port side end portion 9023, and a push-in rib 9021 having a convex shape on the cylindrical outer casing in the vicinity of a side end portion 9022 opposite to the elastic member 906. The inner cylinder 901 and the piston 902 are approximately coaxial.

A push-in detection bar 907 in association with the movement of the piston 902 is disposed between the inner side of the outer cylinder 903 and the outer side of the piston 902. The push-in detection bar 907 is provided with a push-in detection bar contact releasing member 9072 on the discharge port side and a push-in detection bar contact member 9071 on the opposite end of the push-in detection bar contact releasing member 9072 (see FIG. 10C).

A cylinder cover 910 is provided at the opening side end portion of the outer cylinder 903 to prevent the push-in detection bar 907 from falling off.

The inner cylinder 901 and the outer cylinder 903 are provided with inclined shapes 9013 and 9033 in the vicinity of the discharge ports 9011 and 9031, respectively. The inner cross-section for each cylinder gradually decreases with decreasing distance to the discharge ports 9011 and 9031.

The outer cylinder 903 is provided with a first contact plate 908 and a second contact plate 909 between the outer cylinder 903 and the inner cylinder 901, and a storage unit 911 on the outer cylinder in the vicinity of the discharge port 9031 of the outer cylinder 903.

The storage unit 911 is provided with metal plates 9111, 9112, and 9113 (see FIG. 10A).

Operations of a new product detection unit and a rotation detection unit since the toner bottle 900 is attached to a T unit until toner is supplied will be described below.

The new product detection unit will be described below with reference to FIGS. 10A and 10C.

As illustrated in FIGS. 10A to 10F, the push-in detection bar contact releasing member 9072 of the push-in detection bar 907 is positioned in the vicinity of the first contact plate 908 and the second contact plate 909.

In a state before the piston 902 is pushed, the first contact plate 908 and the second contact plate 909 are in contact with each other to achieve conducting.

The first contact plate 908 and the second contact plate 909 are in contact with the metal plates 9111 and 9113 of the storage unit 911, respectively, at the end on the side opposite to the side where the push-in detection bar 907 is disposed.

In this state, the storage unit 911, the first contact plate 908, and the second contact plate 909 form a closed path to achieve conducting.

In a state where the toner bottle unit 900 is attached to the image forming apparatus 100, main body contact portions (not illustrated) and the metal plates 9111 and 9113 are in contact with each other. In this state, when a weak current is sent and conducting is achieved, the image forming apparatus 100 recognizes a state where the piston 902 is not pushed.

Then, as illustrated in FIGS. 10B and 10D, when the piston 902 is pushed, the push-in rib 9021 pushes the push-in detection bar contact member 9071. Then, when the push-in detection bar 907 is pushed toward the discharge port side, the push-in detection bar contact release unit 9072 gets into the contact position between the first contact plate 908 and the second contact plate 909 to disconnect conducting.

The above-described configuration enables the apparatus body to detect that the piston 902 is pushed in upon disconnection of conducting, making it possible to determine whether the toner bottle unit is a new product or used product.

Figure 10F:
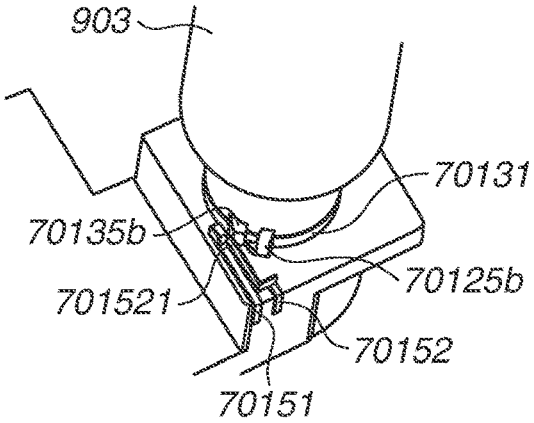

The rotation detection unit will be described below with reference to FIGS. 10E and 10F.

As described above, when the toner bottle unit 900 is rotated, the shutter 904 for sealing the discharge ports 9011 and 9031 opens and closes.

The T unit is provided with the cover member 70131, and the leaf springs 70151 and 70152. The T unit is also provided with a contact portion 701521 at an end of the leaf spring 70152. The projection 70135*b* is formed on the outer circumference of the cover member 70131. Before the rotation of the cover member 70131, the leaf springs 70151 and 70152 are not in contact with each other, and no conducting path is formed.

Then, when the toner bottle unit 900 is attached to the cover member 70131 and then rotated, the projection 70135*b* of the cover member 70131 pushes the contact portion 701521. Accordingly, the back side of the pushed portion comes in contact with the leaf spring 70151, thus forming a conducting path. This enables the apparatus body to detect the rotation of the toner bottle unit 900.

When detaching the toner bottle unit 900, the toner bottle unit 900 is reversely rotated together with the cover member 70131 to cancel the state where the contact portion 701521 is pushed by the projection 70135*b*. Accordingly, the contact portion 701521 comes out of contact with the leaf spring 70151 to disconnect the conducting path and the toner bottle unit 900 can be detached.

The attachment and detachment of the toner reception unit 801 and the toner bottle unit 900 are performed in a similar configuration to the attachment and detachment of the toner pack 40.

Toner Reception Unit

The toner reception unit 801 according to the present disclosure will be described below with reference to FIGS. 1, 4A, 4B, 5A to 5C, 6A, 6B, and 15.

As illustrated in FIG. 1, the toner reception unit 801 is provided with the discharge port 8016*a* (first discharge port) on the side closer to the replenishing port 8012, and a discharge port 8016*b* (second discharge port) on the side further from the replenishing port 8012 in the longitudinal direction (direction P).

The first conveyance member 8015, the second conveyance member 8013, and the third conveyance member 8014 are disposed in the storage chamber 801A of the toner reception unit container 8011.

Then, the first conveyance member 8015 is disposed along an imaginary straight line (first direction 80154) connecting the approximate centers of the discharge ports 8016*a* and 8016*b*. The discharge ports 8016*a* and 8016*b* are disposed to be overlapped with both ends of the first conveyance member 8015.

According to the present exemplary embodiment, the first conveyance member 8015 includes a first conveyance member axis 80150 (rotation shaft), a first rotation conveyance unit 80151 (helical shape) for conveying toner to the discharge port 8016*a*, and a second rotation conveyance unit 80152 (reverse helical shape) for conveying toner to the discharge port 8016*b*.

The first conveyance member axis 80150 is disposed to extend along the direction PS along the first direction 80154. According to the present exemplary embodiment, the direction PS is substantially identical to the first direction 80154.

The first rotation conveyance unit 80151 includes a first vane member 8015A having a predetermined winding direction. The second rotation conveyance unit 80152 includes a second vane member 8015B having a winding direction opposite to the predetermined winding direction.

According to the present exemplary embodiment, a changeover portion 80153 (connection portion) is formed between the first rotation conveyance unit 80151 and the second rotation conveyance unit 80152. The changeover portion 80153 is not provided with a helical shape but formed only of a rotation shaft. The first rotation conveyance unit 80151 and the second rotation conveyance unit 80152 may be continually formed. In this case, the changeover portion 80153 refers to the portion (boundary portion) where the winding directions of the helical portions of the first rotation conveyance unit 80151 and the second rotation conveyance unit 80152 are changed.

According to the present exemplary embodiment, the changeover portion 80153 is formed at a position closer to the discharge port 8016*a* than the longitudinal center position PL of the toner reception unit container 8011.

Therefore, the longitudinal width (length T2) of the second vane member 8015B of the second rotation conveyance unit 80152 is made larger than the longitudinal width (length T1) of the first vane member 8015A of the first rotation conveyance unit 80151.

The second conveyance member 8013 is disposed in parallel with the first conveyance member 8015 in the toner reception unit container 8011.

One end of the second conveyance member 8013 is disposed in the vicinity of the replenishing port 8012. The second conveyance member 8013 is formed of a rotation shaft 80130 and a slit sheet (e.g., a polyethylene terephthalate (PET) sheet) member 80131 assembled to the rotation shaft 80130. When the second conveyance member 8013 is rotated, toner can be conveyed in the direction of the third conveyance member 8014.

The third conveyance member 8014 is disposed between the first conveyance member 8015 and the second conveyance member 8013.

A toner conveyance direction J of the third conveyance member 8014 intersects a toner conveyance direction K1 or K2 of the first conveyance member 8015 or a toner conveyance direction H1 of the second conveyance member 8013.

Figure 5A:
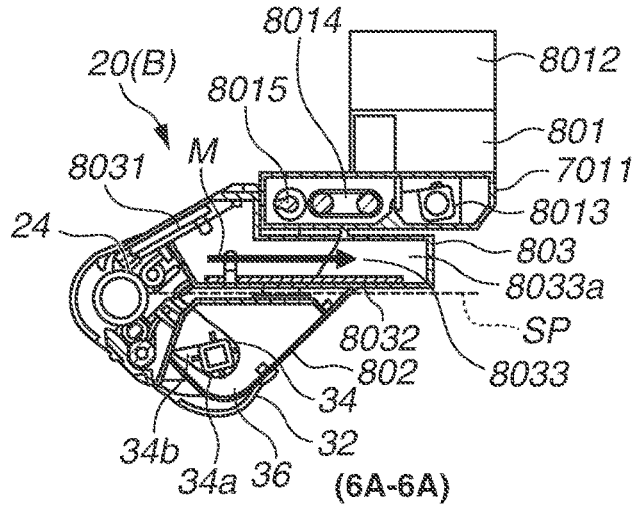
FIG. 5A is a cross-sectional view illustrating the process cartridge taken along the section 6A-6A illustrated in FIG. 4B according to the first exemplary embodiment.
Figure 5B:
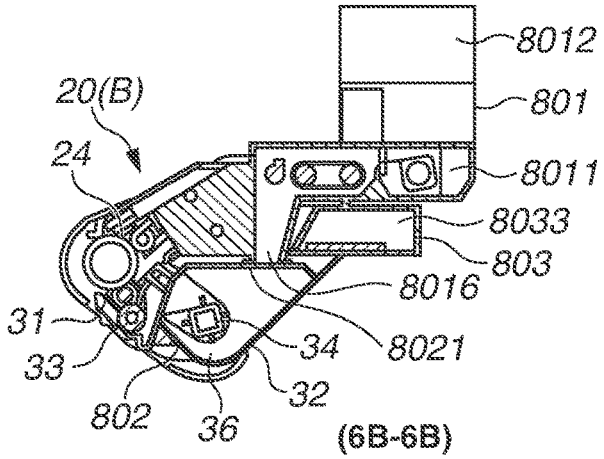
FIG. 5B is a cross-sectional view illustrating the process cartridge taken along the section 6B-6B illustrated in FIG. 4B.
Figure 5C:
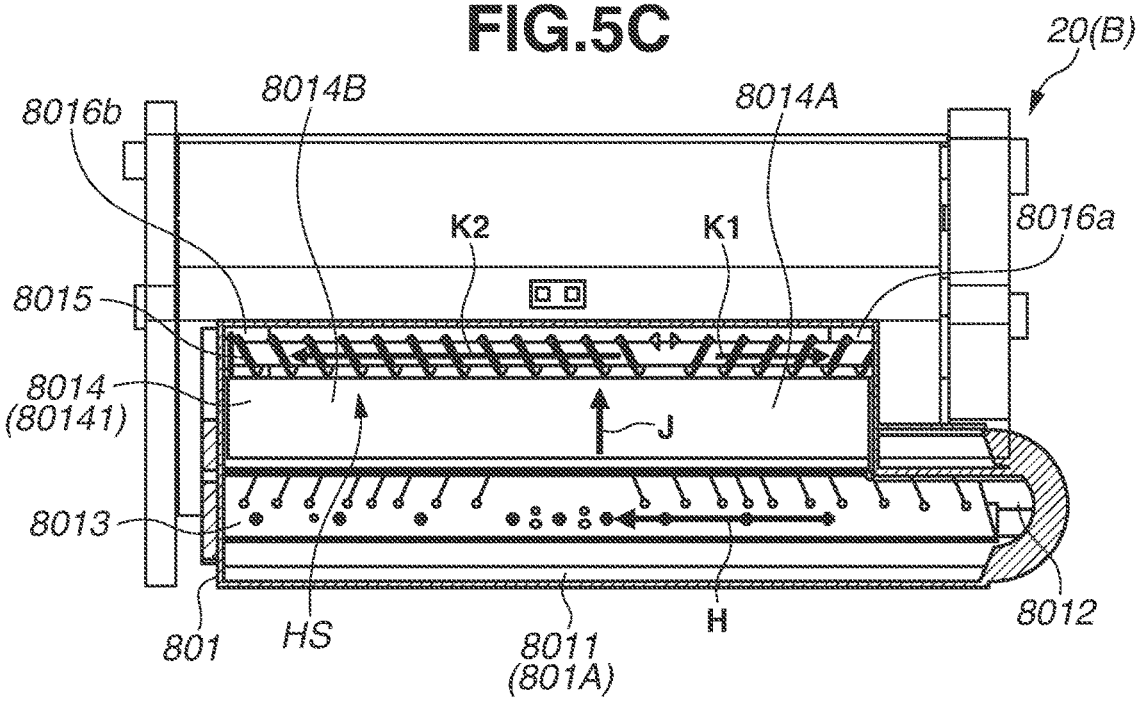
FIG. 5C is a view illustrating a toner moving path in the process cartridge.

The third conveyance member 8014 is formed of two rotation shafts 80140 (see FIGS. 1 and 5A) and a sheet (e.g., a PET sheet) member 80141 wound around the rotation shafts 80140 in belt form. As illustrated in FIGS. 5A to 5C, the sheet member 80141 (endless belt) may be formed of a first belt member 8014A and a second belt member 8014B.

A method for transmitting a driving force to each conveyance member will be described below with reference to FIG. 15.

Figure 15:
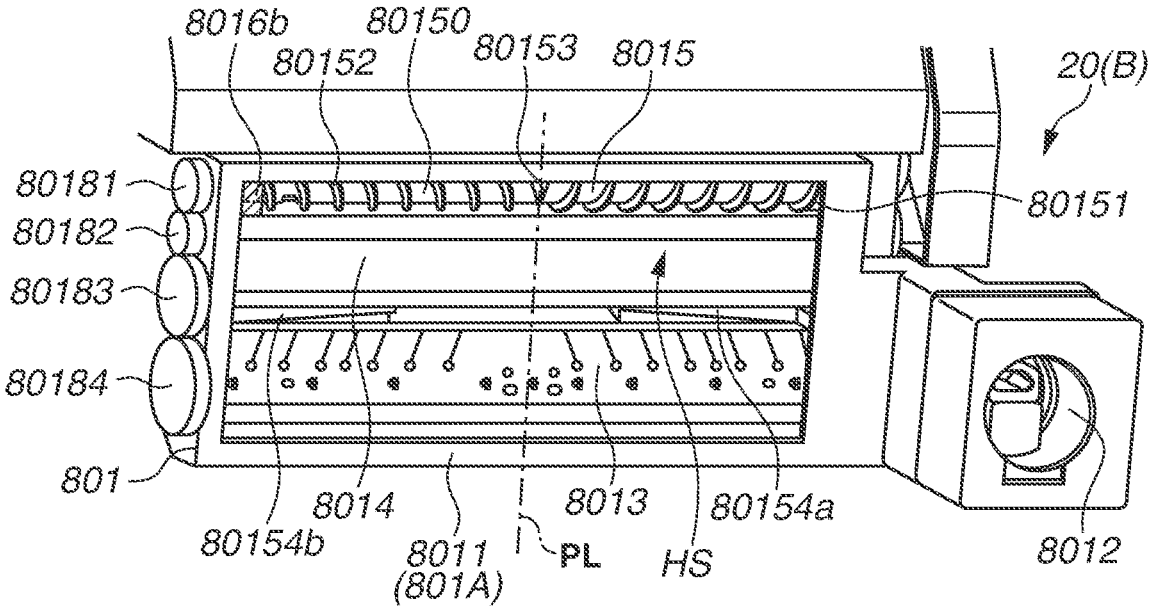
FIG. 15 is a perspective view illustrating a drive train of the toner reception unit according to the first to fifth exemplary embodiments.

As illustrated in FIG. 15, gears 80181, 80182, 80183, and 80184 are provided on the side surface of the toner reception unit container 8011.

The gear 80184 is connected with the second conveyance member 8013 (a connecting portion is not illustrated), and the gear 80181 is connected with the first conveyance member 8015 (a connecting portion is not illustrated).

The gear 80182 is connected with one shaft of the third conveyance member 8014 (a connecting portion is not illustrated) to be integrally rotatable.

When the gear 80184 receives a driving force from the apparatus body A and transmits the driving force to the downstream gears, each conveyance member connected with each gear is rotated.

According to the present exemplary embodiment, an interposing gear is disposed as a configuration for transmitting the driving force from the gear 80184 to the gear 80182. However, instead of using a gear, a belt may be applied between the gears 80184 and 80182 to transmit the driving force.

A moving path (movement) of toner will be described below with reference to FIG. 1.

As illustrated in FIG. 1, toner supplied from the toner pack 40 (see FIGS. 6A and 6B) to the replenishing port 8012 diffuses in the toner reception unit container 8011 in order of V, W, X, and Y centering on the replenishing port 8012.

In this case, a larger amount of toner is accumulated on the side of the discharge port 8016*a* than on the side of the discharge port 8016*b*.

This means that toner is likely to be accumulated in the vicinity of the discharge port 8016*a* or that the discharge port 8016*a* is likely to be clogged with toner.

This also means that a small amount of toner is present in the vicinity of the discharge port 8016*b*.

When the conveyance member 8013 is driven, the accumulated toner is conveyed in the directions H1 and H2. The toner conveyed in the direction H2 is delivered to the third conveyance member 8014, further conveyed in the direction J (second direction) by the third conveyance member 8014, and then delivered to the first conveyance member 8015.

The toner delivered to the first conveyance member 8015 is conveyed to the discharge ports 8016*a* and 8016*b* by the first rotation conveyance unit 80151 and the second rotation conveyance unit 80152, respectively, and then discharged from the respective discharge ports 8016*a* and 8016*b* to the development unit 802 on the downstream side.

According to the present exemplary embodiment, the longitudinal width T2 of the second rotation conveyance unit 80152 is made larger than the longitudinal width T1 of the first rotation conveyance unit 80151.

Therefore, the second rotation conveyance unit 80152 conveys a larger amount of toner than the first rotation conveyance unit 80151 does.

As described above, since the replenishing port 8012 is provided on one longitudinal side, toner is likely to be accumulated on the side of the replenishing port 8012. More specifically, the toner density is different between the two ends of the toner reception unit container 8011.

Since the amount of toner conveyance is increased on the side of the second rotation conveyance unit 80152, toner accumulated in the vicinity of the discharge port 8016*a* can be actively conveyed to the discharge port 8016*b*.

As described above, this configuration enables reducing the amount of toner accumulated in the vicinity of the discharge port 8016*a* to prevent the discharge port 8016*a* from being clogged. At the same time, increasing the amount of toner on the side of the discharge port 8016*b* enables reducing the difference in the amount of toner discharge between the discharge ports 8016*a* and 8016*b* (i.e., both ends in the longitudinal direction).

The present exemplary embodiment is also effective for the following issues in the conventional configuration.

In a toner supply box (hereinafter referred to as a toner conveyance unit) including toner conveyance members in a conventional configuration, the toner supplied from a toner reception slot (hereinafter referred to as a replenishing port) is conveyed to a plurality of toner discharge ports by the toner conveyance members. In such a configuration, since a large amount of toner is conveyed to a toner discharge port in the vicinity of the replenishing port, there has been a possibility that toner is accumulated or that the toner discharge ports are clogged with toner.

As a result, the conventional configuration causes a difference in the amount of toner discharge between the discharge ports. There has been a possibility that, in the downstream image forming processes, the difference prevents uniform toner supply in the longitudinal direction of a developer bearing member, causing image failures.

The configuration of the present exemplary embodiment enables maintaining a uniform amount of toner discharged from a plurality of toner discharge ports and preventing the discharge ports from being clogged with toner. Thus, the configuration of the present exemplary embodiment enables more uniform toner supply in the longitudinal direction, contributing to the improvement in image quality.

Second Exemplary Embodiment

A second exemplary embodiment according to the present disclosure will be described below with reference to FIGS. 4A, 4B, 5A to 5C, 6A, 6B, and 11.

Figure 11:
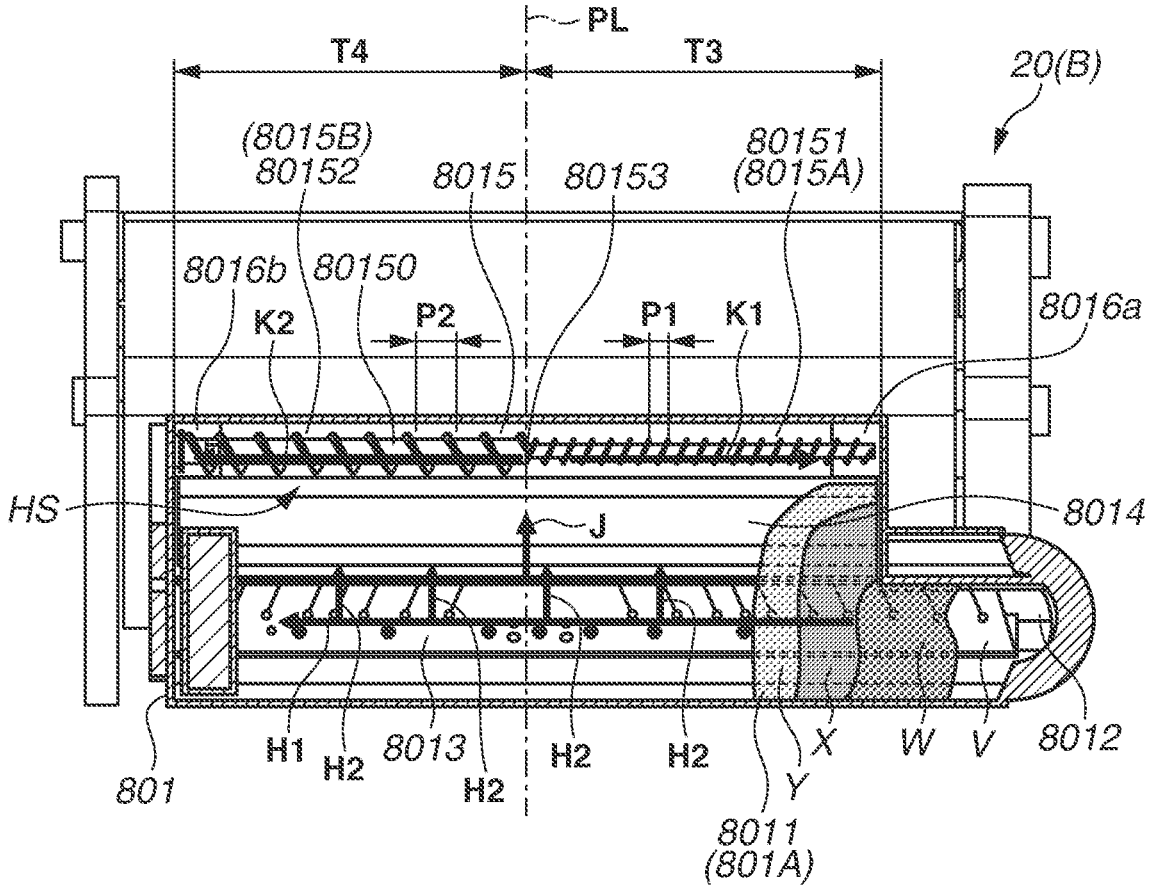
FIG. 11 is a plan view illustrating a toner reception unit (the state where the upper surface is omitted) of a conveyance unit used for an image forming apparatus according to a second exemplary embodiment.

FIG. 11 illustrates an internal configuration of the toner reception unit 801 (the upper surface is not illustrated).

The arrangement and drive of each conveyance member are basically similar to those according to the first exemplary embodiment.

As illustrated in FIG. 11, according to the second exemplary embodiment, the helical pitch distance P2 of the second vane member 8015B of the second rotation conveyance unit (reverse helical shape) 80152 is made longer than the helical pitch distance P1 of the first vane member 8015A of the first rotation conveyance unit (helical shape) 80151.

The area of the helical vane member of the second rotation conveyance unit (reverse helical shape) 80152 is made larger than the area of the helical vane member of the first rotation conveyance unit (helical shape) 80151. More specifically, the second rotation conveyance unit 80152 provides a larger conveyance force than the first rotation conveyance unit 80151.

The changeover portion 80153 is formed at the longitudinal center (PL) of the first conveyance member 8015.

Therefore, the first rotation conveyance unit 80151 and the second rotation conveyance unit 80152 have the same longitudinal width.

This means that, for each rotation of the first conveyance member 8015, the second rotation conveyance member 80152 conveys a larger amount of toner than the first rotation conveyance member 80151.

A moving path (movement) of toner will be described below with reference to FIG. 11.

The toner supplied from the toner pack 40 (see FIGS. 6A and 6B) to the replenishing port 8012 diffuses in the toner reception unit container 8011 in order of V, W, X, and Y centering on the replenishing port 8012.

In this case, a larger amount of toner will be accumulated on the side of the discharge port 8016*a* than on the side of the discharge port 8016*b*.

This means that toner is likely to be accumulated in the vicinity of the discharge port 8016*a* or that the discharge port 8016*a* is likely to be clogged with toner.

This also means that a small amount of toner is present in the vicinity of the discharge port 8016*b*.

Subsequently, when the second conveyance member 8013 is driven, the accumulated toner is conveyed in the directions H1 and H2. The toner conveyed in the direction H2 is delivered to the third conveyance member 8014, further conveyed in the direction J by the third conveyance member 8014, and then delivered to the first conveyance member 8015.

The toner delivered to the first conveyance member 8015 is conveyed to the discharge ports 8016*a* and 8016*b* by the first rotation conveyance unit 80151 and the second rotation conveyance unit 80152, respectively, and then discharged from the respective discharge ports 8016*a* and 8016*b* to the development unit 802 on the downstream side.

According to the present exemplary embodiment, the longitudinal width T4 of the second rotation conveyance unit 80152 is the same as the longitudinal width T3 of the first rotation conveyance unit 80151. When toner is uniformly delivered in the longitudinal direction, almost the same amount of toner will be delivered to the two rotation conveyance units.

However, as described above, a large amount of toner is accumulated in the vicinity of the first rotation conveyance member 80151 (on the side of the discharge port 8016*a*). Therefore, part of toner cannot be conveyed to the discharge port 8016*a* by the first rotation conveyance member 80151, and the remaining toner is pushed out to the vicinity of the second rotation conveyance member 80152.

In this case, since the second rotation conveyance unit 80152 can convey a larger amount of toner than the first rotation conveyance unit 80151, as described above, it can actively convey the pushed-out toner to the discharge port 8016*b*.

The configuration of the present exemplary embodiment enables reducing the amount of accumulated toner on the side of the discharge port 8016*a* and preventing the discharge port 8016*a* from being clogged with toner. At the same time, increasing the amount of toner to be conveyed to the discharge port 8016*b* enables reducing the difference in the amount of toner discharge between the discharge ports 8016*a* and 8016*b* (i.e., between the two ends in the longitudinal direction). Thus, the configuration enables more uniform toner supply in the longitudinal direction, contributing to the improvement in image quality.

Third Exemplary Embodiment

A third exemplary embodiment according to the present disclosure will be described below with reference to FIGS. 4A, 4B, 5A to 5C, 6A, 6B, and 12A to 12C.

Figure 12A:
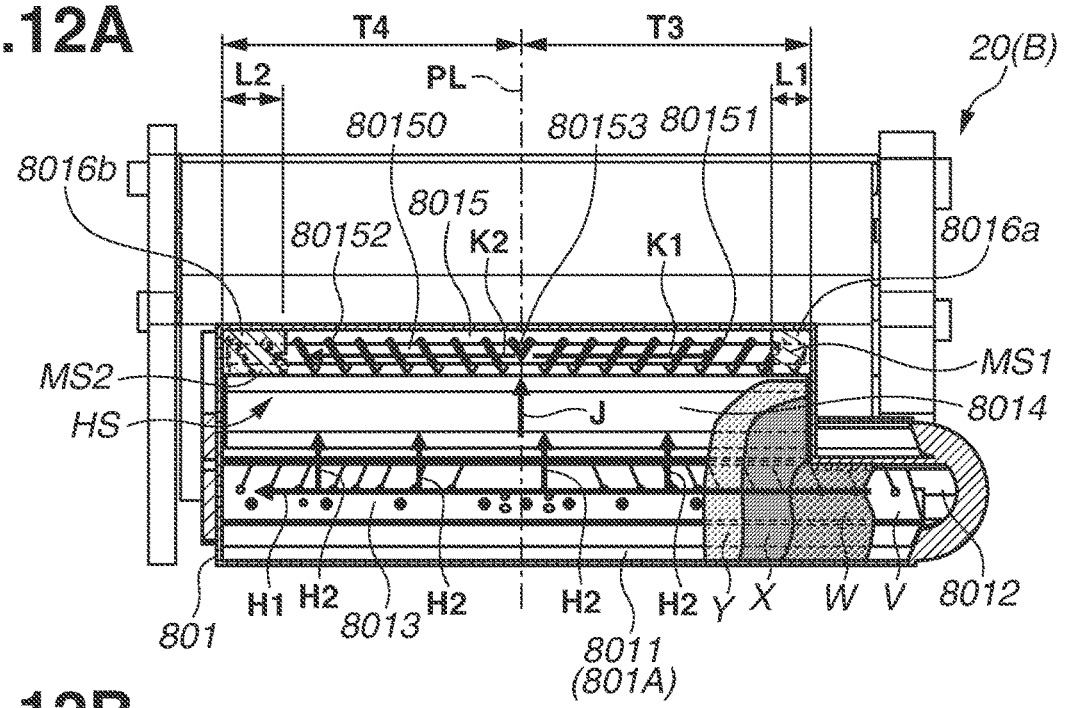
FIG. 12A is a plan view illustrating a toner reception unit (the state where the upper surface is omitted) of a conveyance unit used for an image forming apparatus according to a third exemplary embodiment.

FIG. 12A illustrates an internal configuration of the toner reception unit 801 (the upper surface is not illustrated).

The arrangement and drive of each conveyance member is basically similar to those according to the first exemplary embodiment.

Figure 12B:
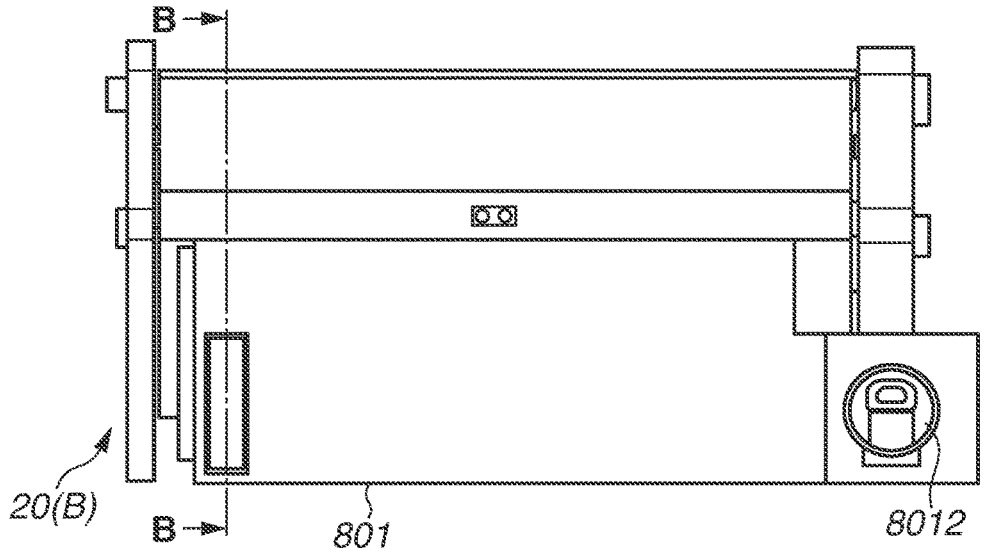
FIG. 12B is a plan view illustrating the upper surface of the toner reception unit.
Figure 12C:
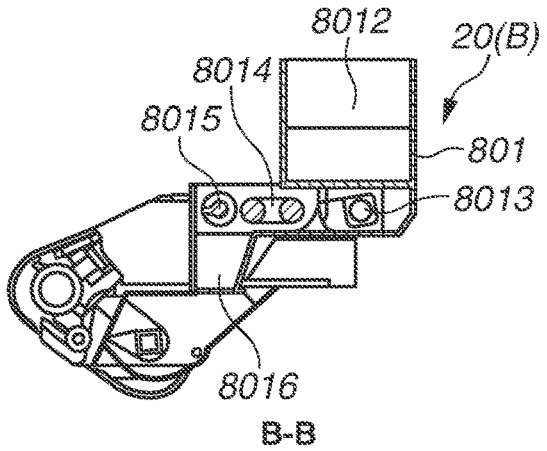
FIG. 12C is a cross-sectional view illustrating the toner reception unit.

As illustrated in FIGS. 12A to 12C, the changeover portion 80153 of the first conveyance member 8015 according to the third exemplary embodiment is formed at the longitudinal center PL of the toner reception unit container 8011.

The discharge ports 8016*a* and 8016*b* formed in the toner reception unit container 8011 have opening widths L1 and L2, respectively, and the discharge port 8016*b* is made larger than the discharge port 8016*a* (L1<L2). More specifically, according to the present exemplary embodiment, an opening area MS2 of the discharge port 8016*b* is larger than an opening area MS1 of the discharge port 8016*a*.

This means that the discharge port 8016*b* can receive a larger amount of toner than the discharge port 8016*a*, and discharge toner to the development unit 802 on the downstream side.

A moving path (movement) of toner will be described below with reference to FIGS. 12A to 12C.

The toner supplied from the toner pack 40 (see FIGS. 6A and 6B) to the replenishing port 8012 diffuses in the toner reception unit container 8011 in order of V, W, X, and Y centering on the replenishing port 8012.

In this case, a larger amount of toner will be accumulated on the side of the discharge port 8016*a* than on the side of the discharge port 8016*b*.

This means that toner is likely to be accumulated in the vicinity of the discharge port 8016*a* or that the discharge port 8016*a* is likely to be clogged with toner.

This also means that a small amount of toner is present in the vicinity of the discharge port 8016*b*.

Subsequently, when the second conveyance member 8013 is driven, the accumulated toner is conveyed in the directions H1 and H2. The toner conveyed in the direction H2 is delivered to the third conveyance member 8014, further conveyed in the direction J by the third conveyance member 8014, and then delivered to the first conveyance member 8015.

The toner delivered to the first conveyance member 8015 is conveyed to the discharge ports 8016*a* and 8016*b* by the first rotation conveyance unit 80151 and the second rotation conveyance unit 80152, respectively, and then discharged from the respective discharge ports 8016*a* and 8016*b* to the development unit 802 on the downstream side.

The longitudinal width T4 of the second rotation conveyance unit 80152 is the same as the longitudinal width T3 of the first rotation conveyance unit 80151. Therefore, toner is approximately uniformly delivered to the first conveyance member 8015 in the longitudinal direction. Thus, almost the same amount of toner will be delivered to the two rotation conveyance units.

However, as described above, a large amount of toner is accumulated in the vicinity of the first rotation conveyance member 80151. Therefore, part of toner cannot be conveyed to the discharge port 8016*a* by the first rotation conveyance member 80151, and the remaining toner is pushed out to the vicinity of the second rotation conveyance member 80152.

In this case, with the increase in the amount of toner in the vicinity of the discharge port 8016*a*, the amount of toner conveyed by the second rotation conveyance unit 80152 increases. However, since the discharge port 8016*b* is largely configured, the toner conveyed by the second rotation conveyance unit 80152 can be smoothly received and discharged without clogging.

As described above, the configuration of the present exemplary embodiment enables reducing accumulated toner on the side of the discharge port 8016*a*, increasing the amount of toner discharge on the side of the discharge port 8016*b*, and thus reducing the difference in the amount of toner discharge between the discharge ports 8016*a* and 8016*b* (i.e., between the two ends in the longitudinal direction). Thus, the configuration enables more uniform toner supply in the longitudinal direction, contributing to the improvement in image quality.

Fourth Exemplary Embodiment

A fourth exemplary embodiment according to the present disclosure will be described below with reference to FIGS. 4A, 4B, 5A to 5C, 6A, 6B, and 13.

Figure 13:
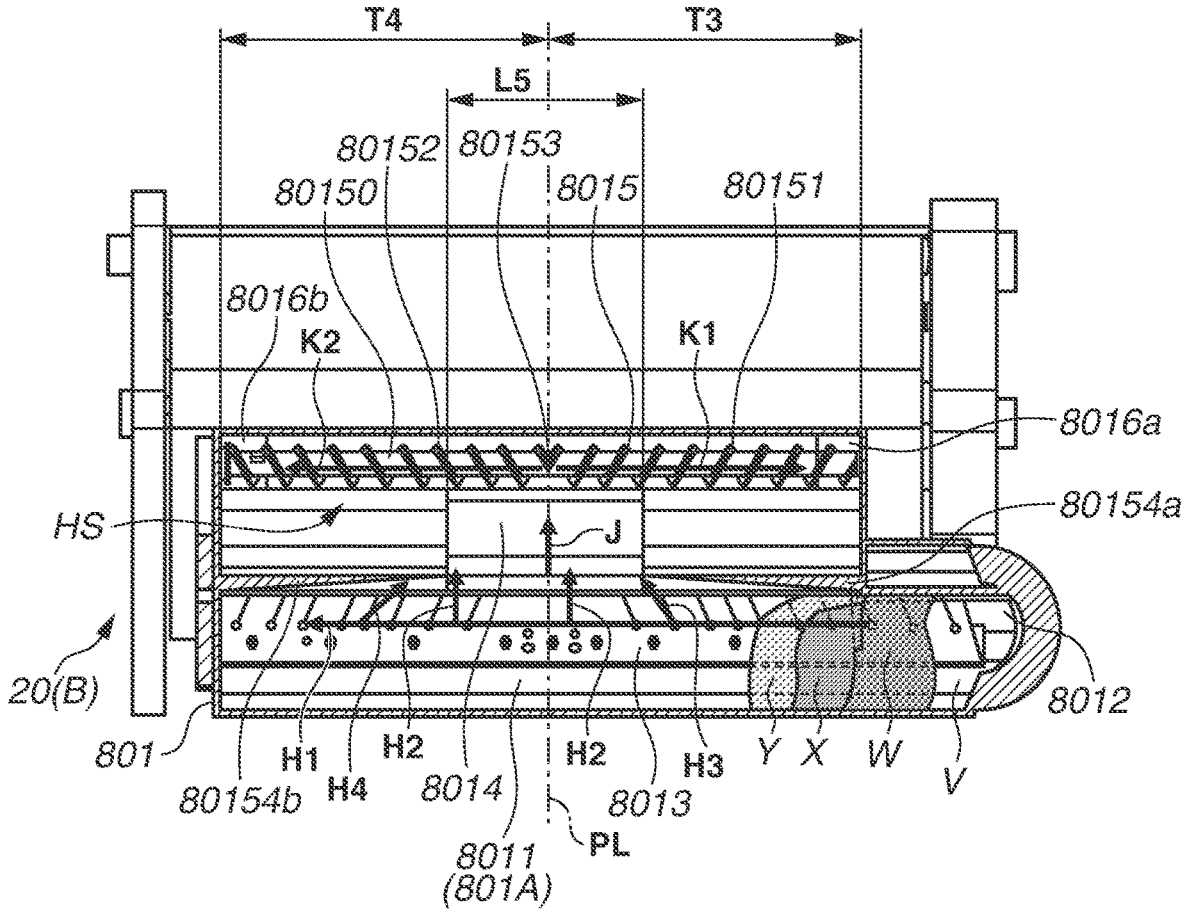
FIG. 13 is a perspective view illustrating a toner reception unit (the upper surface omitted) of a conveyance unit used for an image forming apparatus according to a fourth exemplary embodiment.

FIG. 13 illustrates an internal configuration of the toner reception unit 801 (the upper surface is not illustrated).

The arrangement and drive of each conveyance member is basically similar to those according to the first exemplary embodiment.

As illustrated in FIG. 13, according to the fourth exemplary embodiment, the changeover portion 80153 is formed at the longitudinal center position PL of the toner reception unit container 8011 (the position facing the longitudinal central part of the third conveyance member 8014 to be described below).

Guide-shaped inclined portions (guide members) 80154*a* and 80154*b* are formed between the second conveyance member 8013 and the third conveyance member 8014 in the toner reception unit container 8011.

The guide-shaped inclined portions 80154*a* and 80154*b* are extended from the longitudinal ends toward the central part of the toner reception unit container 8011 to form taper shapes that become further from the second conveyance member 8013 with decreasing distance to the central part.

The tips of the guide-shaped inclined portions 80154*a* and 80154*b* are formed so as to be not connected with but separated from each other by a constant distance L5 at the longitudinal central part of the toner reception unit container 8011.

A moving path (movement) of toner will be described below with reference to FIG. 13.

The toner supplied from the toner pack 40 (see FIGS. 6A and 6B) to the replenishing port 8012 diffuses in the toner reception unit container 8011 in order of V, W, X, and Y centering on the replenishing port 8012.

In this case, a large amount of toner will be accumulated in the vicinity of the replenishing port 8012.

Subsequently, when the second conveyance member 8013 is driven, the accumulated toner is conveyed in the directions H1 and H2. The toner in contact with (guided by) the guide-shaped inclined portions 80154*a* and 80154*b* out of the toner conveyed in the direction H2 changes the moving direction to directions H3 and H4, respectively.

Then, the toner conveyed in the directions H2, H3, and H4 passes through the gap L5 between the guide-shaped inclined portions 80154*a* and 80154*b* and then is delivered to the third conveyance member 8014.

The toner being conveyed by the second conveyance member 8013 is once gathered at the longitudinal central part of the toner reception unit container 8011 by the inclined surfaces of the guide-shaped inclined portions 80154*a* and 80154*b*, and then is delivered to the third conveyance member 8014.

Then, the toner delivered to the third conveyance member 8014 is conveyed in the direction J by the third conveyance member 8014 and then delivered to the first conveyance member 8015.

Then, the toner delivered to the first conveyance member 8015 is conveyed to the discharge ports 8016*a* and 8016*b* by the first rotation conveyance unit 80151 and the second rotation conveyance unit 80152, respectively, and then discharged from the respective discharge ports 8016*a* and 8016*b* to the development unit 802 on the downstream side.

Since the longitudinal width T4 of the second rotation conveyance unit 80152 is the same as the longitudinal width T3 of the first rotation conveyance unit 80151, toner is approximately uniformly delivered to the first conveyance member 8015 in the longitudinal direction. Thus, almost the same amount of toner will be delivered to the two rotation conveyance units.

Therefore, the toner gathered in the vicinity of the changeover portion 80153 at the central part of the first conveyance member 8015 is delivered to the first rotation conveyance unit 80151 and the second rotation conveyance unit 80152 by almost the same amount.

As described above, this configuration enables reducing the difference in the amount of toner discharge between the discharge ports 8016*a* and 8016*b*.

Fifth Exemplary Embodiment

A fifth exemplary embodiment according to the present disclosure will be described below with reference to FIGS. 4A, 4B, 5A to 5C, 6A, 6B, and 14.

Figure 14:
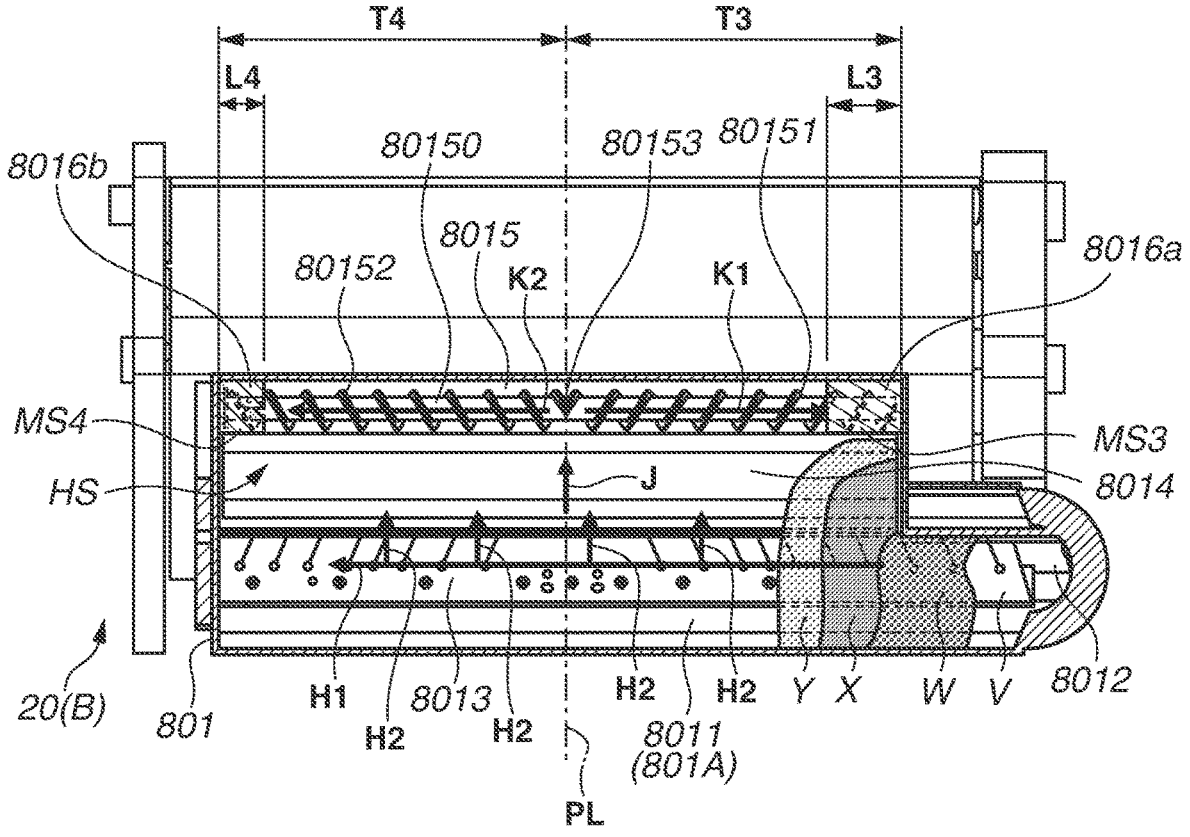
FIG. 14 is a perspective view illustrating a toner reception unit (the state where the upper surface is omitted) of a conveyance unit used for an image forming apparatus according to a fifth exemplary embodiment.

FIG. 14 illustrates an internal configuration of the toner reception unit 801 (the upper surface is not illustrated).

The arrangement and drive of each conveyance member is basically similar to those according to the first exemplary embodiment.

As illustrated in FIG. 14, according to the fifth exemplary embodiment, the changeover portion 80153 of the first conveyance member 8015 is formed at the longitudinal center PL of the toner reception unit container 8011.

In the toner reception unit container 8011, the discharge port 8016*a* is formed at a position closer to the replenishing port 8012, and the discharge port 8016*b* is formed at a position further from the replenishing port 8012.

The discharge ports 8016*a* and 8016*b* have opening widths L3 and L4, respectively, and the discharge port 8016*a* is made larger than the discharge port 8016*b* (L3>L4). More specifically, according to the present exemplary embodiment, an opening area MS3 of the discharge port 8016*a* is larger than an opening area MS4 of the discharge port 8016*b*.

Accordingly, the discharge port 8016*a* can receive a larger amount of toner than the discharge port 8016*b* and discharge toner to the development unit 802 on the downstream side.

A moving path (movement) of the toner will be described below with reference to FIG. 14.

The toner supplied from the toner pack 40 (see FIGS. 6A and 6B) to the replenishing port 8012 diffuses in the toner reception unit container 8011 in order of V, W, X, and Y centering on the replenishing port 8012.

In this case, a larger amount of toner will be accumulated on the side of the discharge port 8016*a* than on the side of the discharge port 8016*b*.

This means that toner is likely to be accumulated in the vicinity of the discharge port 8016*a* or that the discharge port 8016*a* is likely to be clogged with toner.

Subsequently, when the second conveyance member 8013 is driven, the accumulated toner is conveyed in the directions H1 and H2. The toner conveyed in the direction H2 is delivered to the third conveyance member 8014, further conveyed in the direction J by the third conveyance member 8014, and then delivered to the first conveyance member 8015.

Then, the toner delivered to the first conveyance member 8015 is conveyed to the discharge ports 8016*a* and 8016*b* by the first rotation conveyance unit 80151 and the second rotation conveyance unit 80152, respectively, and then discharged from the respective discharge ports 8016*a* and 8016*b* to the development unit 802 on the downstream side.

Since the longitudinal width T4 of the second rotation conveyance unit 80152 is the same as the longitudinal width T3 of the first rotation conveyance unit 80151, toner is approximately uniformly delivered to the first conveyance member 8015 in the longitudinal direction. Thus, almost the same amount of toner will be delivered to the two rotation conveyance units.

As described above, toner accumulated in the vicinity of the discharge port 8016*a* increases the amount of discharged toner. However, the discharge port 8016*a* that is made larger than the discharge port 8016*b* is capable of efficiently discharging the toner conveyed by the first rotation conveyance unit 80151.

The configuration of the present exemplary embodiment enables reducing the amount of accumulated toner in the vicinity of the discharge port 8016*a* to effectively prevent clogging.

According to the above-described present exemplary embodiment, the first conveyance member 8015 and the second conveyance member 8013 may employ a helical screw configuration in which helical shapes are formed on a rotation shaft. The first conveyance member 8015 and the second conveyance member 8013 may also be formed of a rotation shaft and a slit sheet member (e.g., a polycarbonate sheet) assembled to the rotation sheet. In this configuration, when the rotation shaft rotates, the sheet is bent to convey toner in the axial direction.

The configuration of the present disclosure can be summarized as follows:

(1) The conveyance unit 801 of the present disclosure includes the developer container 8011 including the storage chamber 801A for storing the developer, the replenishing port 8012, the first discharge port 8016*a*, and the second discharge port 8016*b*, and the conveyance mechanism HS disposed in the developer container 8011 and configured to convey the developer stored in the storage chamber 801A from the replenishing port 8012 to the first discharge port 8016*a* and the second discharge port 8016*b*. The conveyance mechanism HS includes the rotation shaft 80150 extending in a direction PS along the first direction 80154 connecting the first discharge port 8016*a* and the second discharge port 8016*b*, and configured to be rotatable with a rotation axis extending in the first direction, the first rotation conveyance unit 80151 disposed on the rotation shaft, and configured to be rotatable together with the rotation shaft and convey the developer to the first discharge port 8016*a*, the second rotation conveyance unit 80152 disposed on the rotation shaft, and configured to be rotatable together with the rotation shaft and convey the developer to the second discharge port 8016*b*. The second rotation conveyance unit 80152 is configured to provide a larger amount of conveyance than the first rotation conveyance unit 80151.

The replenishing port 8012 is disposed on one side of the storage chamber 801A for storing the developer in the longitudinal direction P, and configured to supply the developer from outside into the storage chamber 801A. The first discharge port 8016*a* is disposed on one longitudinal side, and configured to discharge the developer from the storage chamber 801A. The second discharge port 8016*b* is disposed on the other longitudinal side, at a position further from the replenishing port 8012 than the first discharge port 8016*a*, and configured to discharge the developer from the storage chamber 801A.

(2) In the conveyance unit of the present disclosure, the first rotation conveyance unit 80151 may include the first vane member 8015A having a predetermined winding direction, and the second rotation conveyance unit 80152 may include the second vane member 8015B having a winding direction opposite to the predetermined winding direction.

(3) In the conveyance unit of the present disclosure, the pitch distance P2 between the vane members of the second vane member 8015B may be made larger than the pitch distance P1 between the vane members of the first vane member 8015A.

(4) In the conveyance unit of the present disclosure, the length of the second vane member, T2, is made longer than the length of the first vane member, T1, in the first direction.

(5) In the conveyance unit of the present disclosure, in the longitudinal direction of the rotation shaft, the connecting portion 80153 connecting the first vane member 8015A and the second vane member 8015B is disposed between the first vane member 8015A and the second vane member 8015B. The connecting portion 80153 may be configured to be closer to the first discharge port 8016*a* than the second discharge port 8016*b*.

(6) In the conveyance unit of the present disclosure, the opening area MS2 of the second discharge port 8016*b* may be made larger than the opening area MS1 of the first discharge port 8016*a*.

(7) In the conveyance unit of the present disclosure, the conveyance mechanism HS may include the first conveyance member 8015 including the rotation shaft 80150, the first rotation conveyance unit 80151, and the second rotation conveyance unit 80152, the second conveyance member 8013 extending in the direction PS along the first direction, and configured to convey the developer from the replenishing port 8012, and the third conveyance member 8014 disposed between the first conveyance member 8015 and the second conveyance member 8013, and configured to convey the developer from the second conveyance member 8013 to the first conveyance member 8015 along the second direction J intersecting the first direction.

(8) In the conveyance unit of the present disclosure, the second conveyance member 8013 may include the second rotation shaft 80130 configured to be rotatable, and the sheet member 80131, of which one end is fixed to the second rotation shaft 80130 and the other end is a free end, configured to rotate together with the second rotation shaft 80130.

(9) In the conveyance unit of the present disclosure, the third conveyance member 8014 may include the endless belt 80141 and the support member 80140 for supporting the endless belt 80141.

(10) In the conveyance unit of the present disclosure, the endless belt 80141 may include the first belt member 8014A and the second belt member 8014B.

(11) The conveyance unit 801 according to another exemplary embodiment of the present disclosure includes the developer container 8011 including the storage chamber 801A for storing the developer, the replenishing port 8012, the first discharge port 8016*a*, and the second discharge port 8016*b*, and the conveyance mechanism HS disposed in the developer container 8011 and configured to convey the developer stored in the storage chamber 801A from the replenishing port 8012 to the first discharge port 8016*a* and the second discharge port 8016*b*. The conveyance mechanism HS includes the first conveyance member 8015 including the rotation shaft 80150, the first rotation conveyance unit 80151, and the second rotation conveyance unit 80152, the second conveyance member 8013 extending in the direction PS along the first direction, and configured to convey the developer from the replenishing port 8012, and the third conveyance member 8014 disposed at the center of the area between the first discharge port 8016*a* and the second discharge port 8016*b* and between the first conveyance member 8015 and the second conveyance member 8013, and configured to convey the developer from the second conveyance member 8013 to the first conveyance member 8015 along the second direction J intersecting the first direction, and the guide members 80154*a* and 80154*b* configured to guide the developer conveyed by the second conveyance member 8013 to the third conveyance member 8014.

The replenishing port 8012 is disposed on one side of the storage chamber 801A for storing the developer in the longitudinal direction P, and configured to supply the developer from outside into the storage chamber 801A. The first discharge port 8016*a* is disposed on one longitudinal side, and configured to discharge the developer from the storage chamber 801A. The second discharge port 8016*b* is disposed on the other longitudinal side, at a position further from the replenishing port 8012 than the first discharge port 8016*a*, and configured to discharge the developer from the storage chamber 801A.

The rotation shaft 80150 is extending in a direction PS along the first direction 80154 connecting the first discharge port 8016*a* and the second discharge port 8016*b*, and is disposed to be rotatable with a rotation axis extending in the first direction. The first rotation conveyance unit 80151 is disposed on the rotation shaft, and is configured to be rotatable together with the rotation shaft and convey the developer toward the first discharge port 8016*a*. The second rotation conveyance unit 80152 is disposed on the rotation shaft, and is configured to be rotatable together with the rotation shaft and convey the developer toward the second discharge port 8016*b*.

(12) The conveyance unit 801 according to another exemplary embodiment of the present disclosure includes the developer container 8011 including the storage chamber 801A for storing the developer, the replenishing port 8012, the first discharge port 8016*a*, and the second discharge port 8016*b*, and the conveyance mechanism HS disposed in the developer container 8011, and configured to convey the developer stored in the storage chamber 801A from the replenishing port 8012 to the first discharge port 8016*a* and the second discharge port 8016*b*. The conveyance mechanism HS includes the rotation shaft 80150 extending in a direction PS along the first direction 80154 connecting the first discharge port 8016*a* and the second discharge port 8016*b*, and configured to be rotatable with a rotation axis extending in the first direction, the first rotation conveyance unit 80151 disposed on the rotation shaft 80150, and configured to be rotatable together with the rotation shaft 80150 and convey the developer toward the first discharge port 8016*a*, and the second rotation conveyance unit 80152 disposed on the rotation shaft 80150, and configured to be rotatable and convey the developer toward the second discharge port 8016*b*. The opening area MS3 of the first discharge port 8016*a* is larger than the opening area MS4 of the second discharge port 8016*b*.

The replenishing port 8012 is disposed on one side of the storage chamber 801A for storing the developer in the longitudinal direction P, and configured to supply the developer from outside into the storage chamber 801A. The first discharge port 8016*a* is disposed on one longitudinal side, and configured to discharge the developer from the storage chamber 801A. The second discharge port 8016*b* is disposed on the other longitudinal side, at a position further from the replenishing port 8012 than the first discharge port 8016*a*, and configured to discharge the developer from the storage chamber 801A.

(13) The process cartridge B of the present disclosure includes the above-described conveyance unit 801, and a developer bearing member 25 configured to bear the developer conveyed by the conveyance unit 801.

(14) The process cartridge B of the present disclosure may further include the image bearing member 601 configured to bear a developer image developed by the developer supplied from the developer bearing member 25.

(15) The process cartridge B of the present disclosure is attachable to and detachable from the apparatus body A of the image forming apparatus 100.

(16) In the process cartridge of the present disclosure, the developer may be a one-component nonmagnetic developer.

(17) The image forming apparatus of the present disclosure includes either one of the above-described conveyance unit 801 and the above-described process cartridges B, and a transfer member 404.

The present disclosure makes it possible to provide an image forming apparatus, and a conveyance unit and a process cartridge used for the image forming apparatus.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. A conveyance unit comprising:

a developer container including:

a storage chamber configured to store developer, a replenishing port disposed on one longitudinal side of the storage chamber, and configured to supply developer from outside to the storage chamber, a first discharge port disposed on the one longitudinal side of the storage chamber, and configured to discharge the developer from the storage chamber, and a second discharge port disposed on the other longitudinal side and disposed at a position further from the replenishing port than the first discharge port, and configured to discharge the developer from the storage chamber, the replenishing port, the first discharge port and the second discharge port being not aligned in a straight line; and a conveyance mechanism disposed in the developer container, and configured to convey the developer stored in the storage chamber from the replenishing port to the first and the second discharge ports, wherein the conveyance mechanism comprises:

a first conveyance member including:

a first rotation conveyance unit configured to convey the developer toward the first discharge port in a first direction connecting the first and second discharge ports; and a second rotation conveyance unit configured to convey the developer toward the second discharge port in the first direction;

a second conveyance member extending in a direction along the first direction, and configured to convey the developer from the replenishing port; and a third conveyance member disposed between the first and second conveyance members in a second direction intersecting the first direction, and configured to convey the developer from the second conveyance member to the first conveyance member along the second direction, wherein the second rotation conveyance unit is configured to provide a larger conveyance capacity than the first rotation conveyance unit.

2. The conveyance unit according to claim 1, wherein the first rotation conveyance unit comprises a first vane member having a predetermined winding direction, and wherein the second rotation conveyance unit comprises a second vane member having a winding direction opposite to the predetermined winding direction.

3. The conveyance unit according to claim 2, wherein a pitch distance between vane members of the second vane member is larger than a pitch distance between vane members of the first vane member.

4. The conveyance unit according to claim 2, wherein, in the first direction, a length of the second vane member is larger than a length of the first vane member.

5. The conveyance unit according to claim 4, wherein, a pitch distance between vane members of the second vane member is same as a pitch distance between vane members of the first vane member.

6. The conveyance unit according to claim 2, wherein, the first conveyance member including a first rotation shaft, in the longitudinal direction of the first rotation shaft, a connecting portion for connecting the first and second vane members is disposed between the first and second vane members, and wherein the connecting portion is closer to the first discharge port than the second discharge port.

7. The conveyance unit according to claim 1, wherein the second conveyance member further comprises:

a second rotation shaft configured to be rotatable; and a sheet member, of which one end is fixed to the second rotation shaft and the other end is a free end, configured to rotate together with the second rotation shaft.

8. The conveyance unit according to claim 1, wherein the third conveyance member further comprises:

an endless belt, and a support member configured to support the endless belt.

9. The conveyance unit according to claim 8, wherein the endless belt includes first and second belt members.

10. The conveyance unit according to claim 1, wherein further comprising a guide member configured to guide the developer conveyed by the second conveyance member to the third conveyance member.

11. The conveyance unit according to claim 1, wherein an opening area of the second discharge port is larger than an opening area of the first discharge port.

12. The conveyance unit according to claim 1, wherein a part of the first rotation conveyance unit is arranged right above the first discharge port so that the developer fall from the first rotation conveyance unit into the first discharged port, and a part of the second rotation conveyance unit is arranged right above the second discharge port so that the developer fall from the second rotation conveyance unit into the second discharged port.

13. A process cartridge comprising:

the conveyance unit according to claim 1; and a developer bearing member configured to bear the developer conveyed by the conveyance unit.

14. The process cartridge according to claim 13, further comprising an image bearing member configured to bear a developer image developed by the developer supplied from the developer bearing member.

15. The process cartridge according to claim 13, wherein the process cartridge is attachable to and detachable from an apparatus body of an image forming apparatus.

16. The process cartridge according to claim 13, wherein the developer is a one-component nonmagnetic developer.

17. An image forming apparatus comprising:

the process cartridge according to claim 13; and a transfer member.

18. An image forming apparatus comprising:

the conveyance unit according to claim 1; and a transfer member.

19. A conveyance unit comprising:

a developer container including:

a storage chamber configured to store developer, a replenishing port disposed on one longitudinal side of the storage chamber, and configured to supply developer from outside to the storage chamber, a first discharge port disposed on the one longitudinal side of the storage chamber, and configured to discharge the developer from the storage chamber, and a second discharge port disposed on the other longitudinal side and disposed at a position further from the replenishing port than the first discharge port, and configured to discharge the developer from the storage chamber, the replenishing port, the first discharge port and the second discharge port being not aligned in a straight line; and a conveyance mechanism disposed in the developer container, and configured to convey the developer stored in the storage chamber from the replenishing port to the first and the second discharge ports, wherein the conveyance mechanism comprises:

a first conveyance member including: a first rotation conveyance unit configured to convey the developer toward the first discharge port in a first direction connecting the first and second discharge ports, and a second rotation conveyance unit configured to convey the developer toward the second discharge port in the first direction;

a second conveyance member configured to convey the developer from the replenish port; and a third conveyance member configured to convey the developer from the second conveyance member towards the first conveyance member, wherein the second rotation conveyance unit is configured to provide a larger conveyance capacity than the first rotation conveyance unit.

20. A conveyance unit comprising:

a developer container including:

a storage chamber configured to store developer, a replenishing port disposed on one longitudinal side of the storage chamber, and configured to supply developer from outside to the storage chamber, a first discharge port disposed on the one longitudinal side of the storage chamber, and configured to discharge the developer from the storage chamber, and a second discharge port disposed on the other longitudinal side and disposed at a position further from the replenishing port than the first discharge port, and configured to discharge the developer from the storage chamber, the replenishing port, the first discharge port and the second discharge port being not aligned in a straight line; and a conveyance member disposed in the developer container and configured to convey the developer stored in the storage chamber to the first and the second discharge ports, wherein the conveyance member comprises:

a first rotation conveyance unit configured to convey the developer toward the first discharge port in a first direction connecting the first and second discharge ports, a part of the first rotation conveyance unit being arranged right above the first discharge port so that the developer fall from the first rotation conveyance unit into the first discharged port, and a second rotation conveyance unit configured to convey the developer toward the second discharge port in the first direction, a part of the second rotation conveyance unit being arranged right above the second discharge port so that the developer fall from the second rotation conveyance unit into the second discharged port and wherein the second rotation conveyance unit is configured to provide a larger conveyance capacity than the first rotation conveyance unit.

* * * * *